US008382916B2

(12) United States Patent
Kuroda et al.

(10) Patent No.: US 8,382,916 B2
(45) Date of Patent: Feb. 26, 2013

(54) METHOD FOR PRODUCTION OF STEEL PRODUCT WITH OUTSTANDING DESCALABILITY; AND STEEL WIRE WITH OUTSTANDING DESCALABILITY

(75) Inventors: Takeshi Kuroda, Kakogawa (JP); Hidenori Sakai, Kakogawa (JP); Mikako Takeda, Kobe (JP); Takuya Kochi, Kobe (JP); Takashi Onishi, Kobe (JP); Tomotada Maruo, Kobe (JP); Takaaki Minamida, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/795,109

(22) Filed: Jun. 7, 2010

(65) Prior Publication Data

US 2010/0236667 A1 Sep. 23, 2010

Related U.S. Application Data

(62) Division of application No. 12/063,324, filed as application No. PCT/JP2006/316021 on Aug. 14, 2006.

(30) Foreign Application Priority Data

Aug. 12, 2005 (JP) ..... 2005-234606
Aug. 17, 2005 (JP) ..... 2005-236782
Jan. 23, 2006 (JP) ..... 2006-014127

(51) Int. Cl.
*C23C 8/18* (2006.01)

(52) U.S. Cl. ..... 148/287; 148/595

(58) Field of Classification Search ..... 148/287, 148/595
See application file for complete search history.

(56) References Cited

U.S. PATENT DOCUMENTS

| | | | | |
|---|---|---|---|---|
| 5,125,987 | A | 6/1992 | Eguchi et al. | |
| 6,258,181 | B1 | 7/2001 | Yamamoto et al. | |
| 6,372,056 | B1 | 4/2002 | Kuroda et al. | |
| 2007/0210186 | A1 * | 9/2007 | Fenton et al. | 239/422 |

FOREIGN PATENT DOCUMENTS

| | | |
|---|---|---|
| EP | 1 674 588 A1 | 6/2006 |
| JP | 53-138917 | 12/1978 |
| JP | 61-48558 | 3/1986 |
| JP | 1-255627 | 10/1989 |
| JP | 02-080520 | 3/1990 |
| JP | 6-10054 | 1/1994 |
| JP | 2000-319730 | 11/2000 |
| JP | 2000-319758 | 11/2000 |
| JP | 2003-171739 | 6/2003 |

OTHER PUBLICATIONS

Machine translation of Hashimoto Yoshihiro, JP06010054A, 1, 1994.*

(Continued)

*Primary Examiner* — Jie Yang
(74) *Attorney, Agent, or Firm* — Oblon, Spivak, McClelland, Maier & Neustadt, L.L.P.

(57) ABSTRACT

The present invention aims at providing a method for production of a steel product which surely retains scale during cooling, storage, and transportation and permits scale to scale off easily at the time of mechanical descaling and pickling that precede the secondary fabrication. The steel product is produced by heating and hot rolling a steel billet and spraying the hot-rolled steel product with steam and/or water mist having a particle diameter no larger than 100 μm, for surface oxidation.

9 Claims, 2 Drawing Sheets

OTHER PUBLICATIONS

NPL: JIS steel composition table (http://www.steel-n.com/esales/general/us/catalog/wire_rod/make.html) online-check 2011.*
Database WPI Week 199839, Thomson Scientific, 1998-450079, XP002596050 (Corresponding to previously filed JP 10-158785).
Extended European Search Report issued Oct. 6, 2010 in EP Application No. 10 00 0034.
Extended European Search Report issued Oct. 8, 2010 in EP Application No. 10 00 0032.
Extended European Search Report Issued Oct. 8, 2010 in EP Application No. 10 00 0033.
Office Action issued Mar. 29, 2011, in Japanese Patent Application No. 2006-236247 (with English-language translation).
Office Action issued Mar. 29, 2011, in Japanese Patent Application No. 2006-222506 (with English-language translation).
Office Action issued Mar. 29, 2011, in Japanese Patent Application No. 2006-220629 (with English-language translation).
Office Action issued Mar. 29, 2011, in Japanese Patent Application No. 2006-226889 (with English-language translation).

* cited by examiner

METHOD FOR PRODUCTION OF STEEL PRODUCT WITH OUTSTANDING DESCALABILITY; AND STEEL WIRE WITH OUTSTANDING DESCALABILITY

CROSS-REFERENCE TO RELATED APPLICATIONS

This application is a divisional application of prior U.S. patent application Ser. No. 12/063,324, the disclosure of which is incorporated by reference in its entirety. U.S. Ser. No. 12/063,324 claims the benefit of priority from prior Japanese Patent Application No. 2005-234606, filed Aug. 12, 2005, Japanese Patent Application No. 2005-236782, filed Aug. 17, 2005, and Japanese Patent Application No. 2006-014127, filed on Jan. 23, 2006 the entire contents of each of which are incorporated herein by reference.

TECHNICAL FIELD

The present invention relates to a method for production of a steel product. The steel product retains oxide scale (simply referred to as scale hereinafter) which forms on the surface thereof at the time of hot rolling. The scale firmly adheres to the steel product for its protection from rusting during cooling, storage, and transportation; however, it easily scales off at the time of descaling and pickling that precede drawing as the secondary processing step for the steel product.

BACKGROUND ART

Any steel product produced by hot rolling needs descaling (which is a step placed before the secondary processing step such as drawing) to remove oxides which form on the surface of a steel billet (as a raw material) during heating and hot rolling. Descaling in practice includes mechanical descaling to remove scale physically or mechanically and pickling to remove scale chemically.

Incomplete descaling, with some scale remaining on the surface of the steel product, causes flaws at the time of drawing due to hard scale, which leads to a decreased die life or even a die breakage, resulting in reduced productivity.

Consequently, any steel product should be produced in such a way that it permits scale to be descaled easily by descaling, such as mechanical descaling (abbreviated as MD hereinafter) and pickling, that precedes the secondary processing step. Mechanical descaling is becoming more popular than before in view of recent environmental issue and cost reduction. Thus the ability of mechanical descaling to remove scale easily is a key to the production of steel products.

Mechanical descaling is physically accomplished by bending with rollers incorporated into the drawing line or by shot-blasting. However, mechanical descaling by bending is not effective if scale has scaled off before the drawing step, because in such a case, rust or thin tertiary scale occurs in scaled parts. The tertiary scale is very thin, hard magnetite scale, which cannot be removed easily by bending, and it breaks the die. Therefore, scale is required to have the property that it does not scale off before the drawing step but scales off easily at the time of bending or pickling.

Scale capable of being scaled off easily by MD or pickling should have a composition with a high content of FeO (wustite). Several ideas have so far been proposed to improve descalability by MD or pickling.

The object is achieved by winding the steel wire at a high temperature of 870 to 930° C. after rolling, thereby allowing easily scalable FeO to occur, and then cooling the steel wire rapidly, thereby suppressing the formation of hard-to-scale $Fe_3O_4$. (See Patent Document 1.) Unfortunately, winding alone at a high temperature is not enough for FeO to occur sufficiently in the case of hard steel wires containing much Si and C which tend to prevent the formation of FeO. Also, even in the case of soft steel wire, the foregoing method is not so effective in improving the MD performance because it merely keeps the steel wire at a high temperature for a very short time which is not enough for FeO to occur sufficiently.

Another method proposed so far consists of winding the steel wire at a temperature no higher than 800° C. and then cooling it at a cooling rate no lower than 0.5° C./sec until it cools from 600° C. to 400° C., thereby suppressing the formation of difficult-to-scale $Fe_2O_4$ (magnetite). (See Patent Document 2.) This method, however, does not form FeO sufficiently, as in the case of the method mentioned above, and hence it does not improve the descalability as intended.

Another method proposed so far is designed to uniformly cooling steel wires with an air blast directed into the hollow center of the coil of the wound steel wire, thereby controlling the composition and thickness of scale in a prescribed range over the entire length of the steel wire. (See Patent Document 3.) This method, however, is not so effective for hard steel wires containing much C and Si on which scale does not form easily.

All of the conventional methods mentioned above suffer the disadvantage that the scale layer in contact with steel is brittle FeO which is poor in adhesion after hot rolling. One way to improve scale adhesion effectively is by formation of fayalite ($Fe_2SiO_4$). However, no detailed investigation has been made from the standpoint of adhesion, and it poses a problem with the rust resistance of steel products.

There are additional methods proposed so far which are mainly designed to improve the mechanical properties of steel products by cooling. (See Patent Documents 4 and 5.) However, they are not satisfactory to give easily scalable scale.

Patent Document 1:
Japanese Patent Laid-open No. Hei-4-293721
Patent Document 2:
Japanese Patent Laid-open No. 2000-246322
Patent Document 3:
Japanese Patent Laid-open No. 2005-118806
Patent Document 4:
Japanese Patent Publication No. Hei-5-87566
Patent Document 5:
Japanese Patent Laid-open No. 2004-10960

DISCLOSURE OF THE INVENTION

Problems to be Solved by the Invention

It is an object of the present invention to provide a method for production of a steel product and also to provide a steel wire, said steel product and said steel wire excelling in scale adhesion as well as descalability. The steel product exhibits its outstanding scale adhesion while it is being cooled after hot rolling and during its storage and transportation. The steel wire exhibits its outstanding descalability at the time of mechanical descaling and pickling which precede the secondary processing step. Thus, the present invention eliminates the disadvantages of the conventional technology involving the descaling of steel products.

Means for Solving the Problems

After their extensive investigations, the present inventors found that oxidation in a wet atmosphere, especially in the presence of steam and/or water mist having a particle diameter no larger than 100 μm, causes a hot-rolled steel product to be covered with FeO (wustite) that readily permits mechanical descaling and pickling and also with $Fe_2SiO_4$ (fayalite) that ensures scale adhesion on the steel product during cooling that follows hot rolling and also during storage and transportation. This finding led to the present invention.

The first aspect of the present invention resides in a method for production of a steel product which permits scale thereon to be descaled easily at the time of descaling, said method comprising heating and hot-rolling a steel billet, especially one containing C: 0.05-1.2 mass % and Si: 0.01-0.50 mass %, and subsequently oxidizing the surface of the hot-rolled steel product in an atmosphere containing steam and/or water mist having a particle diameter no larger than 100 μm.

The present inventors also found that the above-mentioned production method causes a $Fe_2SiO_4$ (fayalite) layer having specific characteristics to be formed uniformly on the steal-scale interface of the hot-rolled steel wire and that the fayalite layer causes the scale that occurs on a steel wire during its cooling to have a residual compressive stress lower than 200 MPa. This finding led to a steel wire which prevents scale from scaling off naturally during cooling (that follows hot rolling), storage, and transportation but permits scale to be descaled easily at the time of mechanical descaling.

Thus, the second aspect of the present invention resides in a steel wire to undergo mechanical descaling which contains C: 0.05-1.2% (in terms of mass % hereinafter), Si: 0.01-0.50%, Mn: 0.1-1.5%, P: no more than 0.02%, S: no more than 0.02%, and N: no more than 0.005%, said steel wire being characterized by having a $Fe_2SiO_4$ (fayalite) layer in contact with the side facing steel of the scale that has formed at the time of hot rolling, said scale having a residual compressive stress smaller than 200 MPa.

The present inventors also found that the scale that forms on the surface of the steel product should be composed of four layers of $Fe_2O_3$, $Fe_2O_4$, FeO, and $Fe_2SiO_4$ (from top to bottom) and that the MD performance depends on their composition. That is, the MD performance improves if the ratio of FeO exceeds 30 vol %, because FeO is brittler and weaker than $Fe_2O_3$ and $Fe_3O_4$. By contrast, the MD performance is poor if the amount of $Fe_2SiO_4$ is smaller than 0.1 vol % (in which case the $Fe_2SiO_4$ layer does not crack easily and hence the scale does not scale off easily at the interface) or if the amount of $Fe_2SiO_4$ exceeds 10 vol % (in which case the $Fe_2SiO_4$ layer bites into the steel like wedges, making it difficult for scale to be descaled).

Thus, the third aspect of the present invention resides in a steel wire which contains C: 0.05-1.2%, Si: 0.01-0.50%, and Mn: 0.1-1.5% and excels in the mechanical descaling performance, said steel wire being characterized by having scale thereon in an amount of 0.1 to 0.7 mass % and also having a $Fe_2SiO_4$ (fayalite) layer in contact with the side facing steel of the scale that has formed at the time of hot rolling, said scale containing FeO in an amount no less than 30 vol % and $Fe_2SiO_4$ in an amount of 0.01-10 vol %.

The present inventors also investigated various steel wires to see the relation between cracks in scale (which are observed in the cross section of a steel wire) and scale adhesion and mechanical descaling performance. As the result, it was found that a steel wire retains its scale during transportation (due to good scale adhesion) but releases its scale easily at the time of mechanical descaling (due to good mechanical descaling performance) if it has scale characterized as follows. The scale on the steel surface has 5 to 20 cracks per 200 μm of interface length in the cross section perpendicular to the lengthwise direction of the steel wire, each crack growing from the interface between the scale and the steel surface and having a length greater than 25% of the scale thickness.

Thus the fourth aspect of the present invention resides in a steel wire which contains C: 0.05-1.2%, Si: 0.01-0.50%, and Mn: 0.1-1.5% and excels in the mechanical descaling performance, said steel wire being characterized by having a $Fe_2SiO_4$ (fayalite) layer in contact with the side facing steel of the scale that has formed at the time of hot rolling and also having scale which has 5 to 20 cracks per 200 μm of interface length in the cross section perpendicular to the lengthwise direction of the steel wire, each crack growing from the interface between the scale and the steel surface and having a length greater than 25% of the scale thickness.

The present inventors also found the following. When scale grows at a high temperature, oxidation makes P to concentrate on the steel-scale interface, thereby forming a P-concentrated part on the interface between steel and $Fe_2SiO_4$ layer. P concentration is hampered if cooling that follows hot rolling is carried out at a properly controlled cooling rate, with the result that the maximum P concentration in the P-concentrated part decreases. If the P concentration is excessively high in the P-concentrated part, scale adhesion becomes extremely poor. However, if it is lower than 2.5 mass %, scale does not scale off easily during cooling that follows hot rolling but remains despite impact during transportation, but scale scales off easily upon mechanical descaling owing to the P-concentrated part.

Thus the fifth aspect of the present invention resides in a steel wire which contains C: 0.05-1.2%, Si: 0.01-0.50%, and Mn: 0.1-1.5% and excels in the mechanical descaling performance, said steel wire being characterized by having a $Fe_2SiO_4$ (fayalite) layer in partial contact with the side facing steel of the scale that has formed at the time of hot rolling and also having a P-concentrated part in the steel-scale interface, with the maximum P concentration being no higher than 2.5 mass %, and a $Fe_2SiO_4$ layer formed immediately above the P-concentrated part.

Effects of the Invention

The first aspect of the present invention produces the following effect. Oxidation of a hot-rolled steel product in a wet atmosphere, especially one containing steam and/or water mist having a particle diameter no larger than 100 μm forms FeO (wustite) necessary for satisfactory mechanical descaling and pickling, and this wustite helps increase the amount of scale and $Fe_2SiO_4$ (fayalite) necessary for the scale to remain on the steel during cooling that follows hot rolling and during storage and transportation. Thus, the method according to the first aspect of the present invention yields a steel product which permits scale to firmly adhere thereto during cooling after hot rolling and during storage and transportation and which also permits scale to be easily descaled at the time of mechanical descaling and pickling that precede the secondary processing step.

The second aspect of the present invention produces the following effect. The uniform $Fe_2SiO_4$ (fayalite) layer formed on the interface between scale and steel of the hot-rolled steel wire makes the scale (that occurs on the steel wire during cooling) have a residual stress no higher than 200 MPa. Such scale does not scale off naturally while the hot-rolled steel wire is being cooled and during its storage and transportation, and yet it is readily descaled at the time of mechanical descaling.

The third aspect of the present invention produces the following effect. FeO is brittler and weaker than $Fe_2O_3$ and $Fe_3O_4$, and hence FeO in a ratio greater than 30 vol % contributes to good MD performance. $Fe_2SiO_4$ exceeding 1 vol % in amount easily cracks and permits scale to scale off easily from the interface. $Fe_2SiO_4$ less than 10 vol % in amount does not bite into the steel like wedges but permits scale to scale off easily, thereby contributing to MD performance.

The fourth aspect of the present invention produces the following effect. Scale on the steel surface has cracks, each growing from the steel-scale interface and having a length no shorter than 25% of the scale thickness. These cracks function as starting points for scale to scale off, especially when there are 5 to 20 cracks per 200 μm of the interface length.

The fifth aspect of the present invention produces the following effect. There occurs a P-concentrated part in which P is concentrated on the steel-scale interface. The P-concentrated part, in which the maximum concentration of P is lower than 2.5 mass %, prevents scale from scaling off during cooling that follows hot rolling and also makes scale resistant to shocks involved in transportation. And yet it permits scale to be descaled easily at the time of mechanical descaling.

BRIEF DESCRIPTION OF THE DRAWINGS

FIG. 4A is a schematic diagram showing the steel and the scale thereon.

Figure 1:
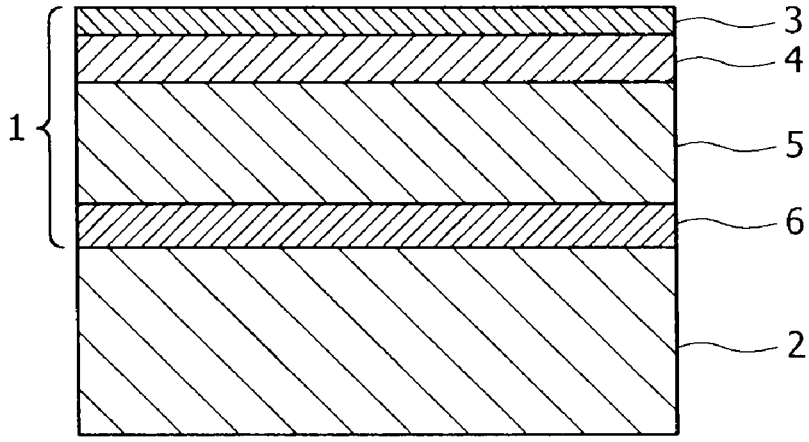
FIG. 1 is a schematic diagram showing the cross section of the scale layer of the steel wire to undergo descaling according to the present invention.

| Explanation of symbols | |
|---|---|
| a, b, and c: | cracks |
| A: | steel |
| B: | P-concentrated part |
| C: | $Fe_2SiO_4$ layer |
| D: | scale |

BEST MODE FOR CARRYING OUT THE INVENTION

The following is a detailed description of embodiments for a steel product pertaining to the present invention and a method for production thereof, as shown in the accompanying drawings, said steel product exhibiting good descalability at the time of descaling.

Embodiment 1

The present invention covers a method for oxidizing the surface of steel, after a steel billet has undergone heating and subsequent hot rolling, by passing the wound steel product through a wet atmosphere having a dew point of 30° C. to 80° C. for 0.1 to 60 seconds. This method permits steam to diffuse into scale to oxidize the steel, thereby forming FeO-rich scale, increasing the amount of scale adhering to the steel, and improving the MD performance.

In addition, the foregoing method forms $Fe_2SiO_4$ (fayalite) on the steel-scale interface, thereby making scale adhere firmly while the hot-rolled steel product is being cooled and during its storage and transportation. The $Fe_2SiO_4$ uniformly forms on said interface through reaction between FeO (which has formed in the steel) and $SiO_2$ originating from Si in the steel product. It firmly adheres to the steel, produces the effect of stress relief accompanied by scale growth, and makes scale adhere stably to the steel surface. Therefore, this scale does not scale off during steel cooling, storage, and transportation, and hence improves corrosion resistance. In addition, $Fe_2SiO_4$ per se is brittle at a low temperature and it neatly scales off from scale steel interface upon bending, without any adverse effect on the MD performance.

The steel product produced by the method according to the present invention permits scale to be readily descaled at the time of descaling by pickling, because it has sufficient FeO, which is brittle and easy to break, and cracks in FeO permit acid to infiltrate into the interface of the steel for efficient dissolution of $Fe_2SiO_4$, without posing any problem with descalability. This effect is different from ordinary oxidation in the atmospheric air, in which case Si in steel turns into $SiO_2$ and diffuses into the surface of the steel. The resulting $SiO_2$ prevents the diffusion of Fe and the formation of sufficient FeO.

The wet atmosphere used in the production method according to the present invention can be readily obtained by spraying steam or water mist having a particle diameter smaller than 100 μm onto the steel surface. Steam surrounding the steel surface diffuses into scale and rapidly oxidizes the steel, thereby forming FeO-rich scale sufficiently on the steel surface as mentioned above and also forming $Fe_2SiO_4$ (fayalite) on the interface between the steel and the FeO.

The steel product produced by the method of the present invention should have scale in an amount of 0.1-0.7 mass %. If the amount of scale is less than 0.1 mass %, the resulting scale is composed mainly of $Fe_3O_4$ (magnetite) which does not scale off readily by mechanical descaling and pickling. By contrast, if the amount of scale is more than 0.7 mass %, the steel product is poor in yields due to scale loss.

The wet atmosphere used in the production method of the present invention should have a dew point of 30-80° C. With a dew point lower than 30° C., the wet atmosphere does not produce the effect of oxidation with steam and hence does not produce scale, FeO, and $Fe_2SiO_4$ sufficiently. With a dew point exceeding 80° C., the wet atmosphere forms scale excessively, which leads to excess scale loss and causes scale to scale off in the course of processing. It also forms $Fe_2O_4$ (magnetite) which is hard to scale in the cooling step, thereby adversely affecting the MD performance.

The dew point can be ascertained by measuring the amount of water in the atmosphere near the steel surface. To be concrete, the atmosphere within a height of 50 cm from the steel surface is sampled for measurement by a dew point instrument.

According to the production method of the present invention, the wet atmosphere is prepared by spraying steam or water mist onto the surface of hot steel for evaporation. In order to ensure the dew point specified in the present invention, the water mist should have a specific particle diameter. Fine water mist having a particle diameter no larger than 100 μm vaporizes by the heat of the steel product to give the dew point of 30° C. and higher (equivalent to about 30 g of water per $m^3$) specified in the present invention. With a particle diameter larger than 100 μm, water mist does not vaporize completely but remains in the form of water drops sticking to the steel surface. This causes the steel surface to steeply decrease in temperature, thereby preventing the formation of sufficient scale. The smaller the mist particle diameter, the faster the evaporation. However, fine mist needs a large amount of high-pressure air and a nozzle with a small orifice. Therefore, the adequate mist particle diameter should be 10-50 μm from the standpoint of cost and stable production. Incidentally, the mist particle diameter is usually measured by the immersion method or laser diffraction method. The mist particle diameter given in the present invention is one which is measured by the laser diffraction method.

According to the production method of the present invention, the steel product should be oxidized with steam in the wet atmosphere for 0.1 to 60 seconds. Oxidation shorter than 0.1 seconds does not produce scale sufficiently, which hinders improvement in descalability at the time of descaling. Oxidation for more than 60 seconds is meaningless without additional scale formation. Moreover, excessively prolonged oxidation with steam will cause excessive surface oxidation, thereby forming hard-to-scale $Fe_3O_4$ (magnetite) scale in the case of some kind of steel. Therefore, duration of oxidation should be no longer than 50 seconds, preferably no longer than 30 seconds.

The oxidation with steam of the steel product should preferably be started at 750-1015° C. With a starting temperature lower than 750° C., oxidation ends at an undesirably low temperature without producing the desired effect. Conversely, with a starting temperature higher than 1015° C., oxidation gives rise to excessive scale, thereby increasing scale loss and decreasing yields. Therefore, the practical starting temperature should be 1015° C. and lower.

In addition, the oxidation with steam of the steel product according to the production method of the present invention should preferably end at a temperature 600° C. and above. Oxidation that ends at a temperature lower than 600° C. does not fully produce its effect but gives rise to hard-to-scale $Fe_3O_4$ (magnetite) scale which is detrimental to descalability at the time of descaling. Therefore, oxidation should preferably be accomplished in such a way that it ends at a temperature 650° C. and above.

The steel product that has undergone hot rolling is oxidized by the production method of the present invention so that it is covered with the so-called secondary scale, as mentioned above. The properties and descalability of the secondary scale depends greatly on the descaling performance of the primary scale that occurs during heating that precedes hot rolling. The primary scale which remains unremoved by descaling is impressed into the steel during rolling, with the steel surface becoming rough. The rough steel surface causes the secondary scale, which occurs later, to bite into the steel surface, thereby deteriorating the descalability of the secondary scale. Therefore, the primary scale that occurs during heating in the heating furnace should be removed as much as possible prior to rolling. For complete removal of the primary scale, descaling with a pressure higher than 3 MPa should be carried out at least once before finish rolling. Descaling may also be carried out while the steel product moves from the heating furnace to the rough rolling mill. Efficient scale removal may be accomplished if descaling is carried out after scale has been crushed to some extent by rough rolling. Descaling with high-pressure water at a pressure lower than 3 MPa is not satisfactory but it aggravates the descalability of the secondary scale. The descaling pressure should be no higher than 100 MPa, preferably no higher than 50 MPa. Descaling at a pressure higher than 100 MPa greatly lowers the surface temperature of the steel product, thereby making rolling difficult.

According to the production method of the present invention, the steel product should be heated at a temperature 1200° C. and below. Heating above 1200° C. gives rise to the primary scale excessively, thereby aggravating the descaling performance and deteriorating the descalability of the secondary scale and also reducing yields due to scale loss. The lower limit of the heating temperature is not specifically restricted; it is properly selected from the standpoint of reduced rolling load. Incidentally, the heating temperature is the surface temperature of the steel billet just discharged from the heating furnace which is measured with a radiation thermometer.

The steel product to which the present invention is applied should contain C: 0.05-1.2 mass % and Si: 0.01-0.5 mass % as major components, and it may contain any other components without specific restrictions. Examples of other components include Mn (0.1-1.5 mass %), Al (no more than 0.1 mass %), P (no more than 0.02 mass %), S (no more than 0.02 mass %), N (no more than 0.005 mass %), Cu, Ni, Cr, B, Ni, Mo, Zr, V, Ti, and Hf. (Preferred amounts are indicated in parentheses.)

C as one major component is an important element that determines the mechanical properties of steel. The content of C should be no less than 0.05 mass % so that the steel product has necessary strength and no more than 1.2 mass % so that the steel product keeps good workability at the time of hot rolling.

Si as another major component functions as a deoxidizer for steel. It also affects the formation of $Fe_2SiO_4$ as an essential component of the scale to be obtained by the present invention. Therefore, the content of Si is specified. That is, the content of Si in steel should be 0.01-0.50 mass % so that scale firmly adheres to the steel and scale remains stably on the steel.

Embodiment 2

The following is a detailed description of the steel wire to undergo mechanical descaling according to the present invention. The present invention covers a steel wire which contains C: 0.05-1.2%, Si: 0.01-0.50%, Mn: 0.1-1.5%, P: no more than 0.02%, S: no more than 0.02%, and N: no more than 0.005%. The steel wire may be produced from any kind of steel, ranging from soft steel to hard steel and including alloy steel, selection of which depends on the properties and quality required of end products.

C is an important element that determines the mechanical properties of steel. The content of C should be no less than 0.05 mass % so that the steel wire has necessary strength and no more than 1.2 mass % so that the steel wire keeps good hot workability at the time of wire production.

Si is necessary as a deoxidizer for steel. It also affects the amount of $Fe_2SiO_4$ (fayalite) as an essential component of the scale to be obtained by the present invention. Therefore, the content of Si is specified. The cooling step involved in hot rolling to produce the steel wire creates a compressive stress in the scale due to difference in thermal expansion coefficient between the scale and the steel. This compressive stress causes scale to scale off naturally while the hot-rolled steel wire is being cooled or while the coiled steel wire is being stored or transported. Such spontaneous scale scaling induces rusting on those spots from which scale has scaled off. Fortunately, the foregoing compressive stress is relieved if there exists a thin uniform fayalite layer on the interface between the scale and the steel.

FIG. 1 schematically shows the layer structure of the scale 1 according to the present invention. The scale 1 consists of four layers—$Fe_2O_3$ layer 3, $Fe_3O_4$ layer 4, FeO layer 5, and $Fe_2SiO_4$ layer 6 (downward)—on the upper surface of the steel 2. This layer structure should be compared with the conventional one consisting of three layers—$Fe_2O_3$, $Fe_3O_4$, and FeO. In this case, the ratio of FeO greatly affects the properties of scale at the time of mechanical descaling. And the scale composition is controlled such that there exists more FeO (which is inherently less in amount than $Fe_2O_3$ and $Fe_3O_4$) for improvement in descalability. Unfortunately, the increased ratio of FeO usually needs the formation of the secondary scale at a high temperature, which results in a thick scale and an increased scale loss. In fact, it is very difficult to achieve the contradictory objects—increasing the ratio of FeO and reducing the scale thickness.

The present invention is based on the finding that the fayalite layer among the four layers constituting the scale is by far weaker in mechanical strength than other oxide layers. This finding suggests that the fayalite layer would be preferentially broken at the time of mechanical descaling if it is formed thin and uniform. Since the fayalite layer is in contact with the steel as shown FIG. 1, its breakage propagates into the entire layers, thereby causing the scale to be easily scaled off and efficiently removed in the form of foil from the steel. As a result, scale does not remain on the surface of the steel wire, even in the form of very fine powder no larger than 0.1 mm. The absence of scale powder facilitates the subsequent drawing step without causing flaws on the surface of the steel wire or reducing the die life. Moreover, the foregoing effect of the fayalite is produced without intentionally increasing the ratio of FeO in the scale layer (or while keeping the fayalite layer thin), and this maintains the yields of the steel.

The foregoing reveals that Si in the steel wire according to the present invention is essential not only as a deoxidizer for steel but also as a component to form the fayalite layer with a specific thickness in the scale. Therefore, the lower limit of the Si content should be 0.01 mass %. Si in an excess amount more than 0.5 mass % forms more fayalite than necessary and extremely deteriorates the mechanical descaling performance. Therefore, the Si content should be in the range of 0.01 to 0.50 mass %.

The controlled Si content as mentioned above permits the thin fayalite layer (0.01-1.0 μm) to be formed uniformly on the surface of the steel. In addition, according to the present invention, the amount of the thin fayalite layer is quantitatively determined in the following way. The cross section of the steel wire is observed under an electron microscope with a magnification of 15000, and the area of the fayalite layer (at the steel-scale interface) that accounts for in the area of the cross section is calculated. The thus calculated value should be no smaller than 60% per 10 μm of length in the cross section.

With a thickness smaller than 0.01 μm, the fayalite layer does not fully relieve the stress of the scale. With a thickness larger than 1.0 μm, the fayalite layer makes the scale adhere to the steel stronger than necessary, thereby making mechanical descaling very difficult. In addition, if the area accounted for by the fayalite layer (determined under the above-mentioned condition) is less than 60%, the fayalite layer does not relieve the stress sufficiently, with the possibility that scale scales off spontaneously.

The fayalite layer which is formed at the bottom of the scale as mentioned above keeps the residual compressive stress (which inevitably remains in the scale) 200 MPa and below, so that it prevents scale from spontaneously scaling off and ensuing rusting that occur while the steel wire is being cooled or being stored and transported.

The amounts of other steel components are specified for reasons given below.

The amount of Mn should be no less than 0.1 mass % so that the steel product has good hardening performance and sufficient strength. However, Mn in an amount exceeding 1.5 mass % segregates in the cooling step which follows hot rolling of steel wire, and this segregation gives rise to supercooled structure such as martensite which is detrimental to drawing.

The amount of P should be no more than 0.02 mass % because P deteriorates the toughness and ductility of steel and causes breakage in the drawing step. It should preferably be no more than 0.01 mass %, more preferably no more than 0.005 mass %.

The amount of S should be no more than 0.02 mass % because S, like P, deteriorates the toughness and ductility of steel and causes breakage in the drawing step and the subsequent twisting step. It should preferably be no more than 0.01 mass %, more preferably no more than 0.005 mass %.

Cr and Ni as optional elements enhance steel hardenability and increase steel strength. However, when added excessively, they give rise to martensite and make the scale hard to scale off. Therefore, their amount should be no more than 0.3 mass % if they are optionally added.

Cu promotes the descalability of scale; however, when added in an amount more than 0.2 mass %, Cu causes the scale to scale off excessively and regenerates a thin, firmly adhering layer of scale on the scaled surface or causes rusting during coil storage.

One or more species of Nb, V, Ti, Hf, and Zr may be added each in an amount no less than 0.003 mass %. They precipitate fine carbonitrides, thereby contributing to the high strength of steel. Their total amount should not exceed 0.1 mass %. Their excessive addition deteriorates the ductility of steel.

Al and Mg are a deoxidizer. The amount of Al should be no more than 0.1 mass % and the amount of Mg should be no more than 0.01 mass %. When added excessively, they give rise to much oxide inclusion, thereby causing frequent wire breakage.

Ca improves the corrosion resistance of the steel product. However, excessive Ca (more than 0.01 mass %) deteriorates workability.

B exists in the steel in the form of free B. It suppresses the formation of the second layer ferrite. When added in an amount no less than 0.0001 mass %, it prevents high-strength steel wire from longitudinal cracking. The amount of B should not exceed 0.005 mass % because excessive B deteriorates the ductility of steel.

According to the present invention, hot rolling is performed in the following manner so that thin layers are formed uniformly in the scale during hot rolling.

First, the steel billet is heated in the heating furnace at a temperature lower than 1200° C. for 30-120 minutes prior to hot rolling. Since the steel contains Si, heating forms fayalite but heating at an excessively high temperature (1200° C. and above) melts the thus formed fayalite and the molten fayalite causes vigorous Fe diffusion, thereby allowing scale to grow rapidly. This is not desirable from the standpoint of scale loss. The lower limit of the heating temperature is determined by the limit of rolling load. In addition, the molten fayalite in the form of liquid layer can be easily removed by descaling with high-pressure water which is performed immediately after the steel billet has been discharged from the heating furnace. Therefore, heating should be performed at a temperature just above 1173° C. which is the melting point of fayalite. In this way it is possible to efficiently remove fayalite without allowing scale to grow rapidly.

Heating at a temperature 1173° C. and above (which is the melting point) for 30-120 minutes completely turns the fayalite that occurs in the heating furnace into the liquid phase.

Immediately after the steel billet has been discharged from the heating furnace, descaling is performed to completely remove the fayalite in its molten state. This descaling may be accomplished by using high-pressure water.

Subsequently, the heated steel billet is made into a wire by hot rolling. Since fayalite occurs also during hot rolling, it is desirable to carry out descaling at least once before finish rolling so as to completely remove the fayalite. This descaling may be accomplished in the usual way by using high-pressure water.

After the inevitably formed fayalite is completely removed as mentioned above, the resulting clean hot-rolled wire immediately before winding is oxidized again at 750-1000° C. in an atmosphere with a dew point of 30-80° C., so that a new thin layer of fayalite is uniformly formed on the steel surface. No elucidation has been made yet as to how the thin film of fayalite is formed by reoxidation in an atmosphere with a high dew point. A probable reason is that steam in the atmosphere with a high dew point acts directly onto the steel-scale interface through the scale layer and reacts with Si oxides uniformly to form $Fe_2SiO_4$ (fayalite) uniformly.

Incidentally, duration of reoxidation mentioned above is several seconds if the wire is running at an ordinary linear speed.

The steel wire which has undergone reoxidation is cooled at a cooling rate no lower than 1° C./sec, preferably no lower than 5° C./sec. This cooling rate is adequate for scale to cool without causing scale loss (which results from excessively slow cooling).

Controlling the scale at the time of hot rolling as mentioned above allows adequate fayalite to occur, and the resulting fayalite effectively relieves the compressive stress of the scale and surely prevents the scale from scaling off spontaneously while the steel wire is being cooled. The result is that the steel wire can undergo mechanical descaling without being hampered by the tertiary scale that inevitably occurs after the scale has scaled off spontaneously.

Embodiment 3

The following is a description of another embodiment for the steel wire with outstanding mechanical descaling performance according to the present invention.

The steel wire pertaining to another embodiment of the present invention contains C: 0.05-1.2 mass %, Si: 0.01-0.50 mass %, and Mn: 0.1-1.5 mass %. It is characterized by having scale in an amount of 0.1-0.7 mass %, with said scale containing FeO in an amount no smaller than 30 vol % and $Fe_2SiO_4$ in an amount of 0.01-10 vol %. It is superior in mechanical descaling (MD) performance.

The steel wire pertaining to Embodiment 3 of the present invention contains specific components, has scale in a specific amount, and has scale with a specific composition, as mentioned above. The reason for this is mentioned in the following.

(1) Components in the Steel Wire

C is an important element that determines the mechanical properties of steel. The steel wire should contain at least 0.05 mass % C for it to have desired strength. On the other hand, excessive C adversely affects hot workability at the time of wire drawing. The upper limit should be 1.2 mass % in consideration of hot workability. Therefore, the amount of C should range from 0.05 to 1.2 mass %.

Si is an element necessary for deoxidization of steel. The lower limit of Si content should be 0.01 mass %. An excessively small Si content results in incomplete deoxidization. The upper limit of Si content should be 0.50 mass %. An excessively large Si content greatly deteriorates the MD performance because it results in excess $Fe_2SiO_4$ (fayalite) and poses a problem with the formation of surface decarburized layer. The Si content should range from 0.01 to 0.50 mass %.

Mn is an important element for the hardenability and strength of steel. An amount necessary for Mn to produce its effect is 0.1 mass % and above, preferably 0.3 mass % and above. The upper limit is 1.5 mass %, preferably 1.0 mass %. Excess Mn segregates in the cooling step that follows hot rolling, thereby forming supercooled structure, such as martensite, which is detrimental to drawing. The Mn content should range from 0.1 to 1.5 mass %, more preferably from 0.35 to 0.8 mass %.

Other components than C, Si, and Mn are not specifically restricted, and the remainder is substantially Fe. The steel product should preferably be incorporated with the following elements for improvement of their characteristic properties such as strength. Moreover, the content of P, S, N, and Al should be limited as specified below.

Cr: 0.1-0.3 Mass % and Ni: 0.1-0.3 Mass %

Both Cr and Ni are elements to improve hardenability and strength. For their desirable effects, their content should be no less than 0.1 mass % each. The upper limit of their content should be 0.3 mass % each. When added in an excess amount, they give rise to martensite and make scale adhere too firmly to be removed easily. They may be added alone or together.

One or More Species of Nb, V, Ti, Hf, and Zr: 0.003-0.1 Mass % in Total

All of Nb, V, Ti, Hf, and Zr precipitate fine carbonitrides, thereby contributing to strength. For their desirable effects, their content should be no less than 0.003 mass % in total. The upper limit of their total content should be 0.1 mass %, because they deteriorate ductility when added excessively. They may be added alone or in combination with one another.

P: No More than 0.02 Mass % (Including 0 Mass %)

P is an element that deteriorates toughness and ductility. The upper limit of P content should be 0.02 mass %, because excessive P causes wire breakage in the drawing step. The P content should be no more than 0.02 mass % (including 0 mass %), preferably no more than 0.01 mass %, and more preferably no more than 0.005 mass %.

S: No More than 0.02 Mass % (Including 0 Mass %)

S, like P, is an element that deteriorates the toughness and ductility of steel. The upper limit of S content should preferably be 0.02 mass % so that the steel wire will not break during drawing and subsequent twisting. Therefore, the S content should be no more than 0.02 mass % (including 0 mass %), preferably no more than 0.01 mass %, and more preferably no more than 0.005 mass %.

N: No More than 0.01 Mass %

N deteriorates the toughness and ductility of the steel wire. Therefore, the N content should preferably be no more than 0.01 mass %.

Al: No More than 0.05 Mass %; Mg: No More than 0.01 Mass %

Al and Mg are effective as a deoxidizer. However, when added excessively, they form oxide inclusions, such as $Al_2O_3$ and $MgO—Al_2O_3$, which cause frequent wire breakage. Therefore, the content of Al and Mg should preferably be no more than 0.05 mass % and no more than 0.01 mass %, respectively.

B: 0.001-0.005 Mass %

B is known to suppress the formation of the second layer ferrite when it exists in the form of free B dissolved in steel. B is useful for production of high-strength steel wire immune to longitudinal cracking. For its desirable effect, B should be added in an amount no less than 0.001 mass %. The upper limit of B content should be 0.005 mass %; excess B more than 0.005 mass % deteriorates ductility.

Cu: 0.01-0.2 Mass %

Cu improves the corrosion-fatigue characteristics. In addition, it concentrates at the steel-scale interface, thereby allowing scale to scale off easily. For its effect, Cu should be added in an amount no less than 0.01 mass %. However, excess Cu causes scale to scale off from the steel wire too easily during transportation, which leads to rusting. Excess Cu also deteriorates the ductility of steel. Therefore, the upper limit of Cu content should be 0.2 mass %.

(2) Amount of Scale Adhering to Steel

It is known that the MD performance is proportional to the amount of scale adhering to steel. However, excess scale lowers yields due to scale loss and also adversely affects drawability because it partly remains without being uniformly removed by MD.

According to the present inventors' investigation as to the amount of scale adhering to steel which is desirable for the MD performance, the adequate amount of scale is 0.1-0.7 mass %. Scale in an amount less than 0.1 mass % is poor in descalability because it is composed mainly of magnetite. It does not scale off easily by MD but it remains on the surface of steel wire after MD. On the other hand, scale in an amount exceeding 0.7 mass % scales off too easily during rolling and transportation, which causes rusting. Such an excess amount of scale is not desirable from the standpoint of scale loss. Therefore, the adequate amount of scale adhering to steel should be 0.1-0.7 mass %.

(3) Composition of Scale

The scale consists of four layers of $Fe_2O_3$, $Fe_3O_4$, FeO, and $Fe_2SiO_4$ (downward). There is an apparent correlation between the amount of FeO in scale and the MD performance. Since FeO is brittler and weaker than $Fe_2O_3$ and $Fe_3O_4$, the higher the ratio of FeO, the better the MD performance. The ratio of FeO exceeding 30 vol % leads to good MD performance.

Excess $Fe_2SiO_4$ bites into the steel surface to extremely deteriorate the MD performance. If the amount of $Fe_2SiO_4$ is adequate, the $Fe_2SiO_4$ layer on the interface cracks and the entire scale scales off from the interface, which leads to improved MD performance. The adequate amount of $Fe_2SiO_4$ is 0.01-10 vol %. The $Fe_2SiO_4$ layer containing less than 0.01 vol % $Fe_2SiO_4$ does not crack easily and hence the scale does not scale off from the interface. On the other hand, $Fe_2SiO_4$ exceeding 10 vol % in the $Fe_2SiO_4$ layer bites into the steel, thereby making it difficult for scale to scale off and aggravating the MD performance.

Therefore, the amount of FeO should be no less than 30 vol %, and the amount of $Fe_2SiO_4$ should be 0.01-10 vol %.

The steel wire pertaining to the present invention is specified for its components, the amount of scale thereon, and the composition of scale thereon, for the reasons mentioned above. Therefore, it is free of problems involved in the conventional technology mentioned above, and it is superior in the MD performance. It permits scale thereon to be removed easily by mechanical descaling. The problem involved in the method disclosed in Japanese Patent Laid-open Nos. Hei-4-293721 and Hei-11-172332 is reduced yields due to thick scale, rusting due to scale scaling (exposure of steel) before MD, and locally remaining scale that prevents smooth drawing. The problem involved in the method disclosed in Japanese Patent Laid-open No. Hei-8-295992 is difficulty in smoothing the steel-scale interface and unstable scale removing process. The problem involved in the method disclosed in Japanese Patent Laid-open No. Hei-10-324923 is difficulty in introducing pores into scale and poor descalability due to stress relieving action by pores. Thus, the steel wire according to the present invention is superior in MD performance and permits easy scale removal by MD.

According to the present invention, the steel wire is produced from a steel billet containing C: 0.05-1.2 mass %, Si: 0.01-0.50 mass %, and Mn: 0.1-1.5 mass %, by hot rolling, winding at 750-850° C., and oxidation in a wet atmosphere having a dew point of 30-80° C. for 0.1 seconds or longer, as mentioned above. It is superior in the MD performance.

The steel wire pertaining to the present invention is produced by the above-mentioned method which specifies the components of the steel wire, the temperature at which the steel wire is wound after hot rolling, and the method of oxidizing the steel wire after winding. This is based on the following ground.

There is an apparent correlation between the MD performance and the amount of scale adhering to the steel wire. The more the amount of scale, the better the MD performance and the less the amount of residual scale. The present inventors found that oxidation in a wet atmosphere containing steam proceeds fast and gives rise to scale in an adequate amount (0.1-0.7 mass %) and with an adequate composition, both necessary for improved MD performance. The desirable amount and composition of scale are achieved by winding the steel wire at 750-850° C. and subsequently oxidizing the wound steel wire in a wet atmosphere having a dew point of 30-80° C. The dew point is ascertained by measuring the amount of water in the atmosphere near the surface of the steel wire. Incidentally, duration of oxidation in the wet atmosphere should be no shorter than 0.1 seconds. Duration shorter than 0.1 seconds is not enough for accelerated oxidation to give a sufficient amount of scale for improved MD performance. Oxidation for a prolonged period turns the surface into $Fe_3O_4$ and reduces the amount of FeO. Thus, the duration of oxidation in the presence of steam should be 60 seconds (at the longest), preferably 30 seconds, more preferably 10 seconds.

The steel wire should contain C: 0.05-1.2 mass %, Si: 0.01-0.50 mass %, and Mn: 0.1-1.5 mass % for the same reason as mentioned above for the steel product according to the present invention.

Therefore, according to the present invention, the steel wire is produced by the process which consists of hot rolling a steel billet containing C: 0.05-1.2 mass %, Si: 0.01-0.50 mass %, and Mn: 0.1-1.5 mass % into a steel wire, winding said steel wire at 750-850° C., and oxidizing the wound steel wire in a wet atmosphere having a dew point of 30-80° C. for 0.1 seconds or longer.

The steel wire of the present invention, which is produced by the above-mentioned method, contains C: 0.05-1.2 mass %, Si: 0.01-0.50 mass %, and Mn: 0.1-1.5 mass %, and has scale adhering thereto in an amount of 0.1-0.7 mass %, said scale containing FeO (no less than 30 vol %) and $Fe_2SiO_4$ (0.01-10 vol %).

Incidentally, terms used in relation to the steel wire of the present invention are defined as follows. The amount (in mass %) of scale adhering to the steel wire is the ratio (percentage) of the mass of scale (adhering to the steel wire) to the mass of the steel wire. In other words, it is expressed as $C=100\times B/A$, where C denotes the amount (in mass %) of scale adhering to the steel wire, A denotes the mass (in g) of the steel wire, and B denotes the mass (in g) of scale adhering to the steel wire.

The content (in vol %) of FeO and $Fe_2SiO_4$ in scale is the ratio (percentage) of the volume of FeO and $Fe_2SiO_4$ to the volume of scale. In other words, it is expressed as $G=100\times E/D$ and $H=100\times F/D$, where D denotes the volume (in $cm^3$) of scale adhering to the steel wire, E and F denote respectively the volume (in $cm^3$) of FeO and $Fe_2SiO_4$ contained in scale, and G and H denote respectively the content (in vol %) of FeO and $Fe_2SiO_4$.

The dew point is ascertained by measuring the amount of water in the atmosphere near the surface of the steel wire. To be concrete, the atmosphere within a height of 50 cm from the surface of the steel wire is sampled for measurement by a dew point instrument. The dew point should preferably be 30-80° C. The wet atmosphere with a dew point lower than 30° C. does not fully produce its oxidizing effect. The wet atmosphere with a dew point higher than 80° C. causes scale to grow excessively to increase scale loss.

Embodiment 4

The following is a description of further another embodiment for the steel wire excelling in mechanical descaling performance according to the present invention.

The steel wire pertaining to further another embodiment of the present invention contains C: 0.05-1.2 mass %, Si: 0.01-0.50 mass %, and Mn: 0.1-1.5 mass %. It is characterized by having scale on the surface thereof and the scale has 5 to 20 cracks per 200 μm of interface length in the cross section perpendicular to the lengthwise direction of the steel wire, each crack growing from the interface between the scale and the steel surface and having a length greater than 25% of the scale thickness.

The steel wire according to the present invention contains specific components and has scale with a specific number of cracks therein, as mentioned above. The reason for this is mentioned in the following. The components of the steel wire are specified for the same reason as mentioned in Embodiment 3.

(1) Specific Number of Cracks in Scale

The present inventors observed the cross section of various steel wires and investigated the adhesion of scale and the mechanical descaling performance. Based on the results of their investigation, they further investigated the relation between the cracks in scale, which are observed in the cross section of the steel wire, and the adhesion of scale and the mechanical descaling performance.

As a result, it was found that the steel wire keeps good scale adhesion during transportation, without scale scaling off easily, but permits scale to scale off easily at the time of mechanical descaling (or exhibits good mechanical descaling performance) if the steel wire has scale on the surface thereof and the scale has 5 to 20 cracks per 200 μm of interface length in the cross section perpendicular to the lengthwise direction of the steel wire, each crack growing from the interface between the scale and the steel surface and having a length no shorter than 25% of the scale thickness. The cracks specified above will be referred to as cracks A hereinafter.

If the number of cracks A is less than 5 per 200 μm of interface length, the steel wire keeps good scale adhesion during transportation, without scale scaling off easily, but it does not permit scale to scale off easily at the time of mechanical descaling or it is poor in the mechanical descaling performance. On the other hand, if the number of cracks A is more than 20 per 200 μm of interface length, the steel wire permits scale to scale off easily during transportation, giving exposed parts on the surface of steel and causing rusting on the exposed parts during storage.

Therefore, for the steel wire to keep good scale adhesion during transportation, without scale scaling off easily, but permits scale to scale off easily at the time of mechanical descaling and exhibits good mechanical descaling performance, the steel wire should have scale on the surface thereof and the scale has 5 to 20 cracks A per 200 μm of interface length in the cross section perpendicular to the lengthwise direction of the steel wire. Thus, the steel wire according to the present invention is specified to have scale on the surface thereof and the scale has 5 to 20 cracks (cracks A) per 200 μm of interface length in the cross section perpendicular to the lengthwise direction of the steel wire, each crack growing from the interface between the scale and the steel surface and having a length no shorter than 25% of the scale thickness.

Incidentally, the steel wire which has undergone hot rolling has scale about 5-20 μm thick, and the scale will have 5 to 20 cracks A per 200 μm of interface length if the steel wire is kept at an adequate temperature and the atmosphere is properly controlled during winding that follows rolling. The above-mentioned cracks A can be noticed by observing the polished cross section (perpendicular to the lengthwise direction of the steel wire) under an optical microscope or scanning electron microscope.

For the reasons mentioned above, the steel wire pertaining to the present invention is composed of specific components and covered with scale having a specific number of cracks A (per 200 μm of interface length). Therefore, it keeps scale firmly adhering thereto, without possibility of scale scaling off easily, during transportation, but it permits scale to scale off easily at the time of mechanical descaling or it exhibits good mechanical descaling performance. Therefore, the steel wire according to the present invention is very little liable to rusting due to scale scaling (which exposes the steel surface) during transportation and yet it permits easy scale removal by mechanical descaling.

For the scale to have 5-20 cracks A per 200 μm of interface length (each crack growing from the steel-scale interface and having a length no shorter than 25% of the scale thickness), it is desirable that the steel wire which has undergone hot rolling should be oxidized in a steam atmosphere or atmospheric air incorporated with steam. (The scale specified above will be referred to as "scale pertaining to the present invention" hereinafter.)

When the steel wire which has undergone hot rolling is oxidized (or steam-oxidized) in a steam atmosphere, steam diffuses into scale and reaches the steel-scale interface, at which steam induces oxidation to form wustite. This wustite is highly compatible with the steel and hence it enhances scale adhesion. At the same time, steam rapidly expands the scale, thereby creating cracks therein due to expanding stress and making the scale ready for scaling. In order to obtain desirable scale by adequately controlling these contradictory effects, it is necessary to adequately control the temperature and duration of oxidation in the steam atmosphere and the amount of steam in the steam atmosphere. To be concrete, steam oxidation should be carried out at about 800-1015° C. for as short a time as possible. In this way it is possible to obtain the scale pertaining to the present invention which has adequate cracks. Steam oxidation for an excessively long time forms a large number of cracks due to expanding stress and does not give the scale pertaining to the present invention. An adequate steam atmosphere is one which has a dew point of 30-80° C. Oxidation in the above-specified atmosphere at about 800-1015° C. for less than 5 seconds gives the scale pertaining to the present invention. Excessive steam brings about excessive oxidation, creating a large number of cracks due to expanding stress, thereby making it impossible to obtain the scale pertaining to the present invention.

The dew point of the steam atmosphere is ascertained by measuring the dew point of the atmosphere near the steel surface. To be concrete, the atmosphere within a height of 50 cm from the steel surface should be sampled for measurement.

Figure 2:
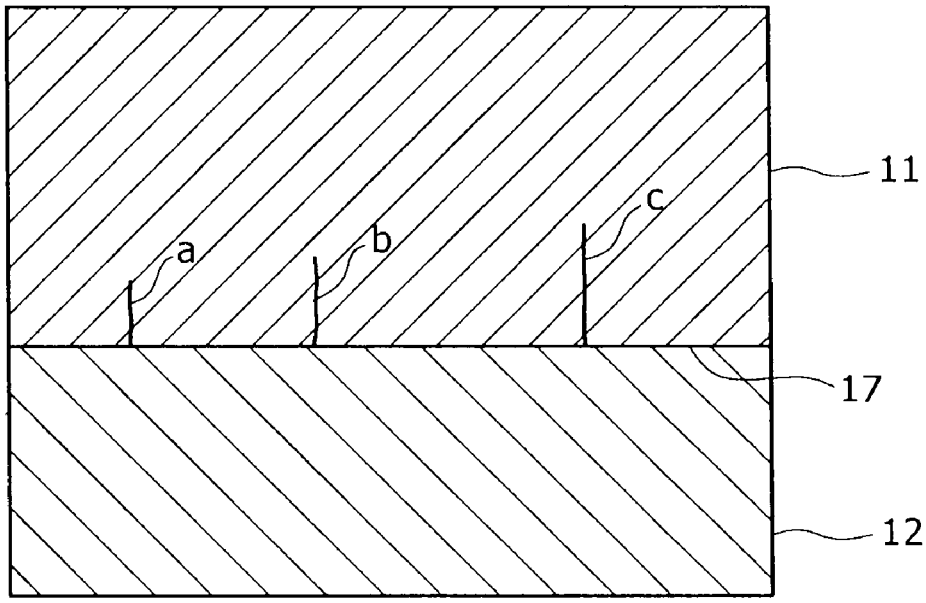
FIG. 2 is a schematic diagram showing the cross section cut in the direction perpendicular to the lengthwise direction of the steel wire.

FIG. 2 is a schematic diagram showing the cross section cut in the direction perpendicular to the lengthwise direction of the steel wire. The symbols a, b, and c in FIG. 2 denote those cracks that have grown from the interface 17 between the scale 11 and the steel 12. The crack a is shorter than 25% of the scale thickness. The crack b is as long as 25% of the scale thickness. The crack c is not longer than 25% of the scale thickness. Of these cracks, the cracks b and c correspond to cracks A (which grow from the steel-scale interface and has a length larger than 25% of the scale thickness). Incidentally, the line representing the scale surface and the line representing the steal-scale interface should be an arc, to be exact. However, the diameter of the steel wire is usually about 5 mm and the thickness of the scale is usually about 10 μm and hence, when enlarged, these lines look like arcs of a circle with a very large diameter and can be approximated by straight lines.

Embodiment 5

The following is a description of further another embodiment for the steel wire excelling in mechanical descaling performance according to the present invention.

The steel wire pertaining to further another embodiment of the present invention contains C: 0.05-1.2 mass %, Si: 0.01-0.50 mass %, and Mn: 0.1-1.5 mass %. It is characterized by having a P-concentrated part on the steel-scale interface and a $Fe_2SiO_4$ layer immediately on it, said P-concentrated part containing no more than 2.5 mass % P.

As mentioned above, the steel wire pertaining to the present invention has a P-concentrated part on the steel-scale interface and a $Fe_2SiO_4$ layer immediately on it, said P-concentrated part containing less than 2.5 mass % P. The reason for this is mentioned in the following. The components of the steel wire are specified for the same reason as mentioned in Embodiment 3.

(1) Reason why a $Fe_2SiO_4$ Layer is Formed Immediately Above P-Concentrated Part at the Steel-Scale Interface:

The scale that forms on the surface of the steel wire is composed of three layers of $Fe_2O_3$, $Fe_3O_4$, and FeO (downward). It is known that the larger the amount of FeO, the better the descalability of scale. However, scale with excess FeO is too thick to be descaled neatly and evenly by mechanical descaling.

The present inventors investigated the relation between the mechanical properties of scale and the descalability of scale. It was found that if a brittle, very hard $Fe_2SiO_4$ layer is formed at the interface between steel and scale (FeO), the $Fe_2SiO_4$ layer cracks at the time of mechanical descaling, thereby facilitating scale scaling.

Formation of $Fe_2SiO_4$ depends largely on the amount of Si and the dew point of atmosphere. In the case of a steel product containing more than 0.5 mass % Si, its oxidation in the atmospheric air easily forms $Fe_2SiO_4$. However, in the case of a steel product containing less than 0.5 mass % Si, its oxidation in the atmospheric air forms $SiO_2$ at the interface but does no form $Fe_2SiO_4$. $SiO_2$ is a hard compact oxide which does not improve the mechanical descaling performance but rather produces an adverse effect. By contrast, oxidation in a steam atmosphere (or an atmosphere with a high dew point) readily forms brittle $Fe_2SiO_4$ through the reaction represented by $2[Fe]+[SiO_2]+2[H_2O]=[Fe_2SiO_4]+2[H_2]$ even in the case of steel product containing no more than 0.5 mass % Si. That is, oxidation in an atmosphere with a dew point no lower than 30° C. forms a $Fe_2SiO_4$ layer even though the Si content is no more than 0.5 mass %.

On the other hand, the $Fe_2SiO_4$ layer with an adequate thickness improves the mechanical descaling performance as well as the adhesion of scale. Firmly adhering scale does not scale off easily during hot rolling and wire transportation. Scale that remains during transportation prevents rusting while the steel wire is being stored for mechanical descaling after transportation. The means to prevent scale from scaling off during hot rolling also prevents formation of tertiary scale in the cooling step that follows hot rolling and winding, which leads to further improvement in the mechanical descaling performance. In other words, the steel wire, with scale scaled off during hot rolling, has its exposed surface covered with thin, firmly adhering scale (tertiary scale) which occurs at a low temperature 400° C. and below in the cooling step that follows winding, and it deteriorates the mechanical descaling performance. Conversely, the steel wire, with scale keeping thereon during hot rolling, does not have its surface covered with tertiary scale detrimental to the mechanical descaling performance, and hence it is improved in the mechanical descaling performance. For such an effect, the $Fe_2SiO_4$ layer should preferably have a thickness of 0.01-1 μm. Any steel wire containing more than 0.5 mass % Si will form excess $Fe_2SiO_4$ (thicker than 1 μm) irrespective of steam in the atmosphere. This layer firmly adheres to steel and aggravates the mechanical descaling performance.

(2) Maximum Concentration of P in the P-Concentrated Part in the Steel-Scale Interface:

While scale is growing at a high temperature, oxidation causes P to concentrate in the steel-scale interface, thereby forming the P-concentrated part immediately under the $Fe_2SiO_4$ layer (or at the interface between the $Fe_2SiO_4$ layer and the steel). Cooling at an adequate rate that follows hot rolling prevents concentration of P, with the maximum concentration of P decreasing in the P-concentrated part. The P-concentrated part with an excessively high P concentration greatly reduces the adhesion of scale. The P-concentrated part with the maximum P concentration no higher than 2.5 mass % prevents scale from scaling off during cooling that follows hot rolling and permits scale to resist impact it receives during transportation. On the other hand, the P-concentrated part contributes to descalability (or allows scale to scale off easily) at the time of mechanical descaling. Incidentally, the P-concentrated part at the interface may be straight or take on a discontinuous stripy pattern.

For the reasons mentioned above, the steel wire according to the present invention should have specific components, a specific maximum P concentration in the P-concentrated part at the steel-scale interface, and a $Fe_2SiO_4$ layer immediately on the P-concentrated part. That is, it should contain C: 0.05-1.2 mass %, Si: 0.01-0.5 mass %, and Mn: 0.1-1.5 mass %, have a P-concentrated part with a maximum P concentration of 2.5 mass % at the steel-scale interface, and have a $Fe_2SiO_4$ layer immediately one the P-concentrated part. Therefore, it prevents scale from scaling off during hot rolling, keeps good scale adhesion during transportation, and permits easy scale scaling during mechanical descaling (or exhibits good mechanical descaling performance). It is exempt from rusting due to scale scaling (or exposure of steel surface) that would otherwise occur during hot rolling and transportation but is ready for descaling at the time of mechanical descaling.

The $Fe_2SiO_4$ layer allows cracks to grow therefrom for easy scale scaling at the time of mechanical descaling, as mentioned above. It also prevents scale from scaling off during hot rolling and transportation. In the former case, the scale that remains during hot rolling prevents formation of tertiary scale in the cooling step that follows hot rolling and winding, thereby further improving the mechanical descaling performance (or preventing the mechanical descaling performance from being deteriorated by tertiary scale). In the latter case, the scale that remains without scaling during transportation prevents rusting during storage that precedes mechanical descaling. For the $Fe_2SiO_4$ layer to fully produce its effect, it should have a thickness of 0.01-1 μm. With a thickness larger than 1 μm, the $Fe_2SiO_4$ layer adheres too firmly to steel and deteriorates the mechanical descaling performance. With a thickness smaller than 0.01 μm, the $Fe_2SiO_4$ layer does not crack easily at the time of mechanical descaling (which is undesirable for scale scaling) and does not completely prevent scale from scaling off during hot rolling and transportation.

As mentioned above, the steel wire according to the present invention has the P-concentrated part at the steel-scale interface, in which the maximum P concentration is 2.5 mass % and on which the $Fe_2SiO_4$ layer is formed. The steel-scale interface of such structure is obtained by oxidizing the steel wire in a short time in an atmosphere with a high dew point while the steel wire is still hot immediately after winding so as to form the $Fe_2SiO_4$ layer preferentially and also by cooling the steel wire after winding as fast as possible so as to reduce the possibility of P getting concentrated. To be concrete, the atmosphere with a high dew point can be produced by spraying the steel wire with hot steam or water mist ready for vaporization. A dew point no lower than 30° C. is desirable for $Fe_2SiO_4$ to form sufficiently. Oxidation in the atmosphere with a high dew point over less than 5 seconds, preferably no more than 3 seconds, is enough to form $Fe_2SiO_4$. Steam oxidation should be carried out at about 750-1015° C. At temperatures lower than 750° C., it does not fully produce its effect, with $Fe_2SiO_4$ produced insufficiently. At temperatures higher than 1015° C., it causes scale to grow rapidly, resulting in scale loss increasing, scale scaling off easily while cooling, and magnetite (tertiary scale) occurring, thereby aggravating mechanical descaling performance. After the $Fe_2SiO_4$ layer with an adequate thickness has been formed by oxidation in a steam atmosphere with a high dew point, the steel wire is cooled to about 600° C. at an increased cooling rate so as to reduce the possibility of P concentrating. (The steel wire is subject to scale growth and P concentration before it cools to 600° C.) The cooling rate should be no lower than 10° C./sec, preferably no lower than 20° C./sec, more preferably no lower than 40° C./sec. Oxidation in the steam atmosphere is followed by water cooling or air cooling. An adequate method for cooling below 600° C. should be selected for the desired structure of the material. Cooling below 600° C. has very little effect on the interface structure itself.

The thickness of the $Fe_2SiO_4$ layer can be ascertained by measuring the thickness of the Si-concentrated layer with a TEM (transmission electron microscope). To be concrete, the measuring method consists of taking samples at three arbitrary points on the cross section of the steel wire, photographing the structure of each sample with a magnification of 5000 and above, measuring the thickness of the $Fe_2SiO_4$ layer at three arbitrary points on one cross section and averaging the measured values, and calculating the average value from measurements at three points on the steel wire. The foregoing procedure gives an accurate thickness of the $Fe_2SiO_4$ layer. The measurement is accomplished by using a transmission electron microscope of field emission type (Model JEM-2010F from JEOL) at an accelerating voltage of 200 kV.

The maximum value of P concentration in the P-concentrated part mentioned above can be ascertained by measuring the P concentration at intervals of 10 nm (in the perpendicular direction) on the steel-scale interface with a TEM-EDX for a beam diameter of 1 nm. To be concrete, the foregoing method is used to measure the maximum values of P concentration at 20 points over an interface length of 500 nm, and an average value (a) is calculated from the 20 measurements. The thus obtained average value is regarded as the maximum value of P concentration. The measurement is accomplished by using a transmission electron microscope of field emission type (Model JEM-2010F from JEOL) at an accelerating voltage of 200 kV and an EDX detector (made by NORAN-VANTAGE).

The steel wire according to the present invention which contains C: 0.05-1.2 mass %, Si: 0.01-0.5 mass %, and Mn: 0.1-1.5 mass % is one which contains C: 0.05-1.2 mass %, Si: 0.01-0.5 mass %, and Mn: 0.1-1.5 mass %, with the remainder being Fe and inevitable impurities, or one which contains C: 0.05-1.2 mass %, Si: 0.01-0.5 mass %, and Mn: 0.1-1.5 mass %, and optionally added elements, with the remainder being Fe and inevitable impurities.

The steel wire which contains Cr: more than 0 mass % and no more than 0.3 mass % and/or Ni: more than 0 mass % and no more than 0.3 mass % is one which contains C: 0.05-1.2 mass %, Si: 0.01-0.5 mass %, and Mn: 0.1-1.5 mass %, and Cr: more than 0 mass % and no more than 0.3 mass % and/or Ni: more than 0 mass % and no more than 0.3 mass %, with the remainder being Fe and inevitable impurities, or one which contains C: 0.05-1.2 mass %, Si: 0.01-0.5 mass %, and Mn: 0.1-1.5 mass %, and Cr: more than 0 mass % and no more than 0.3 mass % and/or Ni: more than 0 mass % and no more than 0.3 mass %, and optionally added elements, with the remainder being Fe and inevitable impurities.

Figure 3:
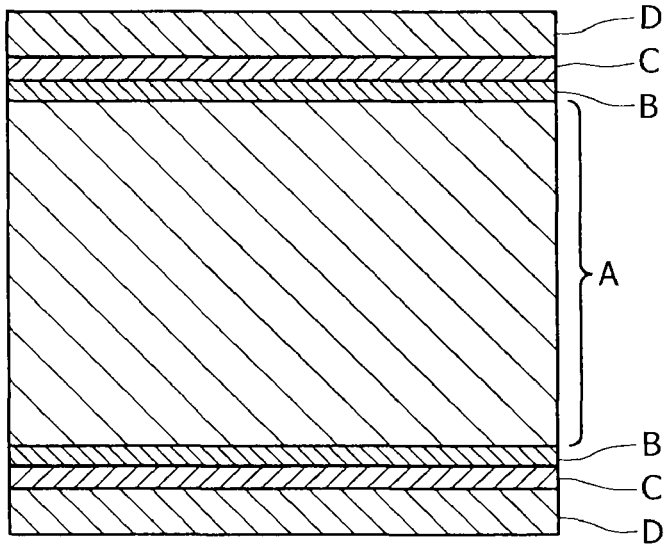
FIG. 3 is a schematic diagram showing an example of the steel-scale interface in the steel wire pertaining to the present invention.
Figure 4A:
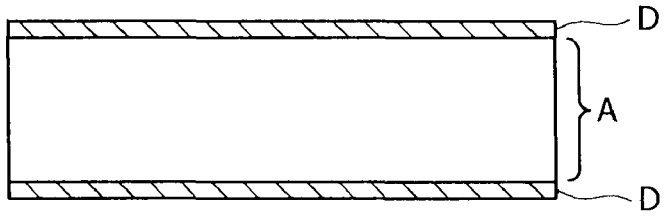
FIG. 4A is a schematic diagram showing an example of the steel-scale interface in the steel wire pertaining to the present invention.
Figure 4B:
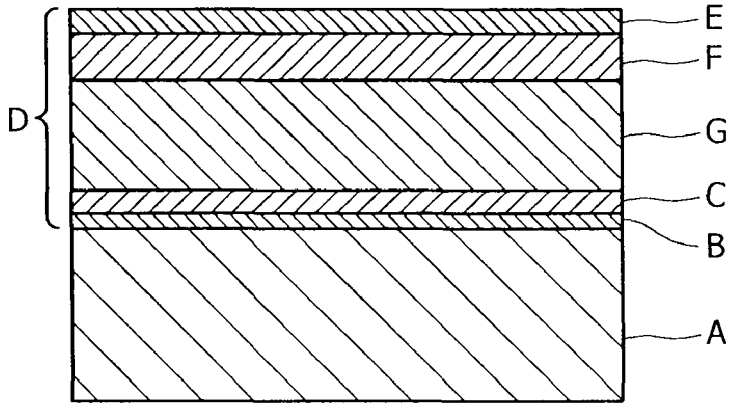
FIG. 4B is a schematic diagram showing the structure of the scale shown in FIG. 4A and also showing the interface between steel and scale.

As mentioned above, the steel wire according to the present invention has the P-concentrated part at the steel-scale interface, in which the maximum P concentration is 2.5 mass %, and also has the $Fe_2SiO_4$ layer on the P-concentrated part. This interface structure is schematically shown in FIGS. 3 and 4 which are sectional views passing through the center line of the steel wire. In FIG. 3, there are shown the steel (A), the P-concentrated part (B), the $Fe_2SiO_4$ layer (C), and the scale or iron oxide (D). The scale (D) on the surface of the steel wire consists of the $Fe_2O_3$ layer (E), the $Fe_3O_4$ layer (F), and the FeO layer (G), which is in contact with the $Fe_2SiO_4$ layer (C). Incidentally, FIG. 3 shows a straight continuous boundary between the P-concentrated part (B) and the $Fe_2SiO_4$ layer (C); however, there may be an instance in which these layers are not continuous. FIG. 4A shows the steel (A) and the scale (D) thereon. FIG. 4B shows the structure of the scale and the steel-scale interface, which are shown in FIG. 4A.

Example 1

The following is a description of Example 1 according to the present invention. First, steel billets (150 mm square) each having the composition shown in Table 1 were prepared. They were heated in a heating furnace and then underwent descaling to remove the primary scale which had occurred during heating. They received hot rolling, which was followed by winding. The wound steel wire was oxidized in a wet atmosphere and finally cooled. Table 2 shows the condition under which the steel billets underwent hot rolling and the wound steel wire underwent oxidation in a wet atmosphere. Table 3 shows the characteristic properties of the scale covering the thus obtained steel wire.

TABLE 1

| Composition of steel samples, in mass % | | | | | | | | | | | |
|---|---|---|---|---|---|---|---|---|---|---|---|
| Steel | C | Si | Mn | P | S | Cu | Ni | Cr | Al | N | B |
| A1 | 0.08 | 0.02 | 0.35 | 0.016 | 0.004 | 0.01 | 0.01 | 0.03 | 0.029 | 0.0024 | — |
| B1 | 0.18 | 0.02 | 0.77 | 0.016 | 0.006 | 0.01 | 0.01 | 0.03 | 0.046 | 0.0050 | — |
| C1 | 0.26 | 0.19 | 0.76 | 0.005 | 0.005 | — | — | — | — | 0.0021 | — |
| D1 | 0.41 | 0.25 | 1.2 | 0.0012 | 0.004 | 0.01 | 0.28 | 0.01 | — | 0.0015 | — |
| E1 | 0.81 | 0.32 | 0.88 | 0.009 | 0.003 | 0.02 | 0.01 | 0.17 | 0.003 | 0.0011 | 0.0026 |
| F1 | 0.92 | 0.42 | 0.52 | 0.011 | 0.005 | 0.01 | 0.02 | 0.01 | 0.002 | 0.0026 | 0.0045 |
| G1 | 1.1 | 0.35 | 0.45 | 0.008 | 0.004 | 0.12 | 0.03 | 0.01 | 0.003 | 0.0011 | 0.0047 |

TABLE 2

| Condition of hot rolling for steel samples | | | | | | | | | |
|---|---|---|---|---|---|---|---|---|---|
| Code | Heating Temperature (° C.) | Descaling pressure (MPa) | Starting temperature of steam oxidation (° C.) | Type of wet atmosphere | Dew Point (° C.) | Duration (sec) | Mist particle diameter (μm) | Finish Temperature of steam oxidation (° C.) | N.B. |
| a1 | 1150 | 4 | 770 | Mist | 78 | 25 | 10 | 740 | Working samples |
| b1 | | | 770 | Steam | | 55 | — | 725 | |
| c1 | 1000 | 45 | 830 | Mist | 63 | 10 | 18 | 810 | |
| d1 | | | 830 | Steam | | 25 | — | 810 | |
| e1 | 1050 | 5 | 900 | Mist | 55 | 5 | 28 | 790 | |
| f1 | | | 900 | Steam | | 5 | — | 900 | |
| g1 | 950 | 8 | 975 | Mist | 45 | 1 | 45 | 895 | |
| h1 | | | 985 | Mist | 65 | 10 | 98 | 605 | |
| i1 | | | 985 | Mist | 65 | 8 | 98 | 650 | |
| j1 | | | 975 | Steam | 45 | 3 | — | 975 | |
| k1 | 1050 | 3 | 900 | Mist | 31 | 10 | 95 | 595 | |
| l1 | 1180 | 15 | 950 | Mist | 52 | 15 | 110 | 605 | |
| m1 | 1250 | 25 | 800 | Mist | 65 | 11 | 17 | 785 | |
| n1 | 1120 | 35 | 700 | Mist | 26 | 5 | 28 | 590 | Comparative samples |
| o1 | 1065 | 20 | 1050 | Steam | 29 | 9 | — | 1045 | |
| p1 | 1120 | 5 | 800 | Mist | 10 | 15 | 145 | 480 | |
| q1 | 1080 | 25 | 880 | Steam | 90 | 5 | — | 880 | |
| r1 | 1170 | 10 | 800 | Mist | 67 | 0.05 | 15 | 799 | |
| s1 | 1170 | 30 | 800 | Steam | 80 | 0.05 | — | 800 | |
| t1 | 1170 | 30 | 800 | Mist | 30 | 65 | 94 | 680 | |
| u1 | 1095 | 25 | 760 | Steam | 50 | 70 | — | 705 | |

TABLE 3

| No. | Steel | Rolling conditions | Whether or not $Fe_2SiO_4$ occurred | Amount of adhering scale (mass %) | Ratio of scale scaled off from rolled steel wire (%) | Amount of scale remaining after MD (mass %) | N.B. |
|---|---|---|---|---|---|---|---|
| 101 | A1 | a1 | ○ | 0.65 | 2.5 | 0.008 | Working samples |
| 102 | C1 | b1 | ○ | 0.42 | 1.8 | 0.034 | |
| 103 | B1 | c1 | ○ | 0.70 | 2.2 | 0.003 | |
| 104 | E1 | d1 | ○ | 0.32 | 1.6 | 0.011 | |
| 105 | C1 | e1 | ○ | 0.40 | 0.3 | 0.024 | |
| 106 | F1 | f1 | ○ | 0.51 | 1.8 | 0.018 | |
| 107 | D1 | g1 | ○ | 0.48 | 0.5 | 0.023 | |
| 108 | G1 | h1 | ○ | 0.55 | 0.6 | 0.042 | |
| 109 | E1 | c1 | ○ | 0.29 | 0.6 | 0.031 | |
| 110 | F1 | e1 | ○ | 0.42 | 0.4 | 0.029 | |
| 111 | G1 | g1 | ○ | 0.46 | 1.3 | 0.021 | |
| 112 | E1 | i1 | ○ | 0.51 | 1.1 | 0.023 | |
| 113 | D1 | j1 | ○ | 0.42 | 0.9 | 0.016 | |
| 114 | E1 | k1 | ○ | 0.42 | 1.5 | 0.048 | |
| 115 | F1 | l1 | ○ | 0.46 | 1.2 | 0.040 | |
| 116 | A1 | m1 | ○ | 0.60 | 2.8 | 0.049 | |
| 117 | E1 | n1 | X | 0.08 | 0.3 | 0.076 | Comparative samples |
| 118 | B1 | o1 | ○ | 0.83 | 61 | 0.13 | |
| 119 | G1 | p1 | X | 0.09 | 0.2 | 0.088 | |
| 120 | F1 | q1 | ○ | 0.78 | 45 | 0.18 | |
| 121 | A1 | r1 | X | 0.07 | 0.4 | 0.069 | |
| 122 | E1 | s1 | X | 0.09 | 0.1 | 0.089 | |

TABLE 3-continued

| No. | Steel | Rolling conditions | Whether or not $Fe_2SiO_4$ occurred | Amount of adhering scale (mass %) | Ratio of scale scaled off from rolled steel wire (%) | Amount of scale remaining after MD (mass %) | N.B. |
|---|---|---|---|---|---|---|---|
| 123 | F1 | t1 | ○ | 0.45 | 1.2 | 0.11 | |
| 124 | C1 | u1 | ○ | 0.33 | 0.8 | 0.097 | |

The heading "Ratio of scale scaled off from rolled steel wire (%)" in Table 3 represents how firmly scale adheres to the steel wire after hot rolling. To evaluate adhesion, three specimens (each 500 mm long) are taken from the wound steel wire cut at its both ends and center, and the entire surface of each specimen is photographed with a digital camera. The resulting photograph is analyzed by an image processing program which gives the ratio (%) of area in which scale has scaled off. Measurements of the three specimens are averaged. Samples are regarded as acceptable if they have a ratio of scale scaling no higher than 3%.

Scale was also examined for composition by X-ray diffractometry applied to arbitrary three points on each of three specimens (10 mm long) of the wound steel wire cut at its both ends and center. In addition, the following procedure was carried out to measure the amount of scale on the steel wire and the descalability of scale (in terms of the amount of scale remaining after mechanical descaling). First, a specimen (250 mm long) is taken from the steel wire. The specimen is weighed. The measured weight is converted into a weight (W3) of a specimen which is 200 mm long (corresponding to the distance between chucks mentioned later). Then, the specimen is held between chucks 200 mm apart and stretched until the displacement of the crossheads reaches 12 mm (4%). After dismounting from the chucks, the specimen has its scale scaled off by air blow. The specimen is cut to a length of 200 mm and weighed (W1). The specimen is immersed in hydrochloric acid for complete removal of scale. The specimen is weighed again (W2). The amount of residual scale is calculated from the formula (1) below. Samples are regarded as acceptable if the amount of residual scale is less than 0.05 mass %. The amount of scale adhering to the steel wire is also calculated from the formula (2) below.

$$\text{Residual scale (mass \%)}=(W1-W2)/W1\times 100 \quad (1)$$

$$\text{Adhering scale (mass \%)}=(W3-W2)/W3\times 100 \quad (2)$$

(Working Samples Nos. 101-116)

These samples have scale in a desirable amount of 0.1 to 0.7 mass % and with a desirable composition containing $Fe_2SiO_4$. This is because they have their primary scale, which occurs during heating, removed completely by descaling and subsequently have their surface oxidized by spraying with mist or steam under adequate conditions. Consequently, they exhibit outstanding MD performance, with very little scale remaining after MD. Moreover, they scarcely suffer scale scaling after rolling and they have such good rust resistance that they need no rust preventive.

(Comparative Sample No. 117)

This sample underwent steam oxidation which had started and ended at a lower temperature than specified, which resulted in incomplete reaction with steam and scale unsatisfactory in composition (lacking $Fe_2SiO_4$) and amount. This led to the poor MD performance.

(Comparative Sample No. 118)

This sample underwent steam oxidation which had started at a higher temperature than specified, which resulted in vigorous oxidation by steam and excessively thick scale in an amount exceeding 0.7 mass %. Such scale scaled off in the cooling step, giving rise to the thin tertiary scale (magnetite: $Fe_2O_4$), which hardly scales off at the time of cooling. This led to the poor MD performance.

(Comparative Sample No. 119)

This sample underwent steam oxidation with mist having an excessively large particle diameter (and hence having an excessively low dew point), which resulted in incomplete reaction with steam and scale unsatisfactory in composition (lacking $Fe_2SiO_4$) and amount. This led to the poor MD performance.

(Comparative Sample No. 120)

This sample underwent steam oxidation in an atmosphere having an excessively high dew point, which resulted in vigorous oxidation by steam and excessively thick scale that scaled off in the cooling step, giving rise to the thin tertiary scale (magnetite: $Fe_3O_4$), which hardly scales off at the time of cooling. This led to the poor MD performance.

(Comparative Samples Nos. 121 and 122)

This sample underwent steam oxidation for an excessively short time, which resulted in scale unsatisfactory in composition (lacking $Fe_2SiO_4$) and amount. This led to the poor MD performance.

(Comparative Samples Nos. 123 and 124)

This sample underwent steam oxidation for an excessively long time, which resulted in excess surface oxidation and gave rise to magnetite ($Fe_3O_4$) that hardly scales off. This led to the poor MD performance.

Incidentally, Example 1 mentioned above involves the steam oxidation which was carried out after the steel billet had undergone hot rolling and the resulting steel wire had been wound. However, Example 1 is not intended to restrict when to carry out steam oxidation. Steam oxidation can be carried out at the time of winding, for example. In other words, steam oxidation can be carried out at any time after hot rolling.

Example 2

The following is a description of Example 2 according to the present invention. Working samples and comparative samples of steel wire in this example were prepared from ten kinds of steel billet varying in composition as shown in Table 4 by the way differing in scale conditioning. In other words, each steel billet having the composition shown in Table 4 underwent hot rolling and scale conditioning under the conditions shown in Table 5. The thus obtained samples of steel wire were examined for scale characteristics. The results are shown in Table 6. Working samples as specified in the present invention are described first.

Each steel billet shown in Table 4 was heated in a heating furnace at a temperature (a2-c2) shown in Table 5. This heating was carried out to melt $Fe_2SiO_4$ formed by heating, thereby preventing rapid scale growth. The heating temperature is close to the melting point of $Fe_2SiO_4$ (1173° C.) and lower than 1200° C. Immediately after heating, the heated billet underwent descaling by high-pressure water for complete removal of $Fe_2SiO_4$ and then underwent hot rolling. In the case where $Fe_2SiO_4$ occurred again during the stepwise rolling, descaling was repeated as many times as necessary until finish rolling. The resulting clean steel wire was wound at 750-1000° C. and, immediately after winding, the steel wire underwent reoxidation in a wet atmosphere having a high dew point (a2-c2) shown in Table 5, so that they were uniformly coated with $Fe_2SiO_4$ thin film.

TABLE 4

| Composition of steel billets, in mass % | | | | | | | | | | | | |
|---|---|---|---|---|---|---|---|---|---|---|---|---|
| Steel | C | Si | Mn | P | S | N | Cr | Ni | Cu | Al | B | Others |
| A2 | 0.05 | 0.08 | 0.48 | 0.003 | 0.004 | 0.0021 | — | — | — | 0.023 | — | — |
| B2 | 0.15 | 0.05 | 0.55 | 0.002 | 0.003 | 0.0015 | 0.01 | — | — | 0.088 | — | — |
| C2 | 0.22 | 0.28 | 1.35 | 0.004 | 0.004 | 0.0022 | — | — | — | — | — | Ca 0.003 |
| D2 | 0.68 | 0.12 | 0.67 | 0.005 | 0.007 | 0.0015 | 0.17 | 0.02 | 0.03 | 0.002 | 0.0008 | Ti 0.03 |
| E2 | 0.82 | 0.25 | 0.44 | 0.002 | 0.005 | 0.0021 | 0.03 | 0.01 | 0.02 | 0.045 | — | — |
| F2 | 0.65 | 0.28 | 0.52 | 0.001 | 0.005 | 0.0018 | 0.18 | 0.03 | 0.16 | 0.003 | 0.0023 | Mg 0.005 |
| G2 | 0.93 | 0.45 | 0.63 | 0.009 | 0.005 | 0.0050 | 0.06 | 0.01 | 0.06 | 0.026 | 0.0026 | Ti 0.02<br>Hf 0.02 |
| H2 | 1.20 | 0.39 | 0.52 | 0.022 | 0.021 | 0.033 | 0.03 | 0.02 | 0.01 | 0.004 | 0.0041 | — |
| I2 | 1.12 | 0.34 | 0.45 | 0.011 | 0.010 | 0.0029 | 0.02 | 0.01 | 0.03 | 0.003 | 0.0028 | Zr 0.02<br>Nb 0.04 |
| J2 | 0.76 | 0.48 | 0.56 | 0.003 | 0.002 | 0.0014 | 0.02 | 0.21 | 0.01 | 0.015 | 0.0047 | V 0.05 |

TABLE 5

| Conditions of scale conditioning | | | | | | |
|---|---|---|---|---|---|---|
| | Condition of scale conditioning during hot rolling | | | | | |
| Code | Billet heating temperature (° C.) | Billet heating time (min) | Temperature of wire winding (° C.) | Dew point (° C.) | Cooling rate after winding (° C./s) | Class |
| a2 | 1175 | 60 | 750 | 45 | 1 | Working samples |
| b2 | 1100 | 35 | 850 | 50 | 5 | |
| c2 | 1183 | 50 | 950 | 38 | 15 | |
| d2 | 1100 | 90 | 875 | 85 | 10 | Comparative samples |
| e2 | 1150 | 50 | 850 | 12 | 10 | |
| f2 | 1250 | 60 | 800 | 40 | 15 | |
| g2 | 1180 | 60 | 1100 | 50 | 1 | |

Incidentally, the comparative samples underwent scale conditioning under different conditions. That is, in the case of (d), the dew point in reoxidation is higher than specified; in the case of (e), the dew point in reoxidation is lower than specified; and in the case of (f), the billet heating temperature in the heating furnace is high. The comparative sample (f) lacks uniform $Fe_2SiO_4$ film because the $Fe_2SiO_4$ that has occurred in the heating furnace melts due to the high billet heating temperature and the molten $Fe_2SiO_4$ permits vigorous diffusion of Fe, which promotes rapid scale growth. The resulting scale cannot be removed completely by the subsequent descaling step but it is forced into the surface during hot rolling, with the interface becoming rough. The comparative sample (g) has excess scale, which scaled off during cooling, on account of the excessively high winding temperature.

Various kinds of steel wires were prepared from different steels under different conditions. They were examined for scale properties. The results are shown in Table 6.

TABLE 6

| Characteristic properties of scale | | | | | | | |
|---|---|---|---|---|---|---|---|
| | | | | Scale | | | |
| | | $Fe_2SiO_4$ | | Residual | | Remaining | |
| Test No. | Steel/ condition | Thickness (μm) | Growth length (%) | stress (MPa) | Scaling ratio (%) | amount (mass %) | Class* |
| 201 | A2/a2 | 0.06 | 72 | 176 | 2.4 | 0.018 | w.s. |
| 202 | A2/c2 | 0.12 | 81 | 136 | 1.8 | 0.022 | w.s. |
| 203 | A2/f2 | 0.28 | 19 | 265 | 42 | 0.11 | c.s. |
| 204 | A2/g2 | 0.19 | 65 | 198 | 65 | 0.12 | c.s. |
| 205 | B2/b2 | 0.07 | 76 | 164 | 2.2 | 0.027 | w.s. |
| 206 | B2/e2 | 0.02 | 13 | 271 | 45 | 0.13 | c.s. |
| 207 | C2/c2 | 0.25 | 67 | 172 | 2.5 | 0.032 | w.s. |
| 208 | C2/d2 | 1.1 | 86 | 140 | 0.7 | 0.22 | c.s. |
| 209 | D2/a2 | 0.05 | 65 | 186 | 2.6 | 0.023 | w.s. |
| 210 | D2/c2 | 0.18 | 78 | 145 | 2.2 | 0.031 | w.s. |
| 211 | D2/d2 | 1.3 | 90 | 164 | 0.5 | 0.25 | c.s. |
| 212 | D2/f2 | 0.23 | 32 | 240 | 45 | 0.19 | c.s. |
| 213 | E2/b2 | 0.09 | 62 | 176 | 2 | 0.036 | w.s. |
| 214 | E2/e2 | 0.02 | 21 | 226 | 48 | 0.21 | c.s. |
| 215 | E2/g2 | 0.13 | 68 | 186 | 61 | 0.17 | c.s. |
| 216 | F2/c2 | 0.34 | 75 | 122 | 1.8 | 0.028 | w.s. |
| 217 | F2/d2 | 1.2 | 80 | 153 | 0.8 | 0.18 | c.s. |
| 218 | G2/a2 | 0.42 | 65 | 135 | 2.3 | 0.013 | w.s. |
| 219 | G2/c2 | 0.66 | 72 | 124 | 1.9 | 0.024 | w.s. |
| 220 | G2/e2 | 0.03 | 19 | 249 | 49 | 0.16 | c.s. |
| 221 | G2/f2 | 1.5 | 72 | 105 | 0.9 | 0.19 | c.s. |
| 222 | H2/b2 | 0.59 | 70 | 110 | 1.6 | 0.025 | w.s. |
| 223 | H2/d2 | 1.5 | 88 | 157 | 0.2 | 0.12 | c.s. |
| 224 | I2/c2 | 0.68 | 76 | 98 | 0.9 | 0.016 | w.s. |
| 225 | I2/a2 | 0.59 | 64 | 106 | 1.4 | 0.033 | w.s. |
| 226 | J2/a2 | 0.74 | 78 | 110 | 0.2 | 0.026 | w.s. |
| 227 | J2/c2 | 0.98 | 82 | 89 | 0.1 | 0.013 | w.s. |

TABLE 6-continued

| Characteristic properties of scale | | | | | | | |
|---|---|---|---|---|---|---|---|
| | | | | Scale | | | |
| | | $Fe_2SiO_4$ | | Residual | | Remaining | |
| Test No. | Steel/ condition | Thickness (μm) | Growth length (%) | stress (MPa) | Scaling ratio (%) | amount (mass %) | Class* |
| 228 | J2/e2 | 0.12 | 43 | 272 | 40 | 0.19 | c.s. |
| 229 | J2/f2 | 1.7 | 64 | 124 | 0.8 | 0.23 | c.s. |

*w.s. = working sample, c.s. = comparative sample

The growth of $Fe_2SiO_4$ was investigated as follows. One each of specimen is taken from the sample of steel wire at both ends and center thereof. The cross section of the specimen is photographed at four points by an electron microscope (×15000), and four measurements of $Fe_2SiO_4$ thickness are averaged. The growth length of $Fe_2SiO_4$ is determined by measuring the length of the $Fe_2SiO_4$ layer per 10 μm of length on the steel surface, and the result is indicated in terms of an average value.

The residual stress of scale is measured by X-ray diffractometry (sin 2ϕ method). This method is based on the following principle. The peaks of diffraction which are observed when a sample is irradiated with X-rays change in position if the sample has a residual stress. In other words, the position of diffraction peaks changes as the incident angle (ϕ) of X-rays changes. The change of position is plotted on the ordinate and sin 2ϕ of the incident angle is plotted on the abscissa, and a regression line is drawn by the least square method. The slope of the regression line is multiplied by the stress constant obtained from Young's modulus and Poisson ratio, and the stress value (or the residual stress of scale in Table 6) is calculated from the formula (3) below.

$$\sigma=-E/2(1+\nu)\cdot\cot\theta\cdot\pi/180\cdot M=K\cdot M \quad (3)$$

where,

| | |
|---|---|
| σ: | value of stress (MPa) |
| E: | Young's modulus (MPa) |
| ν: | Poisson ratio |
| 2θ: | angle of diffraction in the absence of strain (°) |
| K: | stress constant (MPa) |
| M: | slope of regression line (2θ vs. sin2θ) |

The peaks of diffraction due to the 311 plane of FiO (wustite) as one constituent of scale adjacent to the steel were selectively examined. The measurement of residual stress by X-rays was carried out under the following conditions.

Apparatus: PSPC from Rigaku Denki (apparatus for measuring stress in a minute part by X-rays Characteristic X-ray: Cr-Kα

Tube voltage and current: 40 kV, 30 mA

X-ray beam diameter: 1.0 mm

Measuring method: tilt method

Angle of measurement (2θ): 123.6°

Angle of ϕ: 0, 14, 19, 24, 28, 31, 35, 38, 42, 45°

Duration of X-ray irradiation: 300 sec/ϕ

The analysis of FeO (wustite) was carried out under the following condition.

Plane of diffraction: FeO (311)

Angle of diffraction (2θ): 123.6°

Stress constant: −467.92 MPa/deg

Young's modulus: 130000 MPa

Poisson ratio: 0.3

To examine how firmly scale adheres to the steel wire after hot rolling, three specimens (each 500 mm long) are taken from the wound steel wire cut at its both ends and center, and the entire surface of each specimen is photographed with a digital camera. The resulting photograph is analyzed by an image processing program which gives the ratio (%) of area in which scale has scaled off. Measurements of the three specimens are averaged. The results are shown in Table 6 under the heading of "Scale—scaling ratio".

The lower the scale scaling ratio measured by the foregoing method, the better the hot rolled steel wire in scale adhesion during its cooling, storage, and transportation.

Moreover, in order to evaluate the mechanical descaling performance, each sample of steel wire was examined for the descalability of scale and the residual amount of scale in the following way. First, a specimen (250 mm long) is taken from the steel wire. Then, the specimen is held between chucks 200 mm apart and stretched until the displacement of the cross-heads reaches 12 mm (4%). After dismounting from the chucks, the specimen has its scale mechanically scaled off by air blow. The specimen is cut to a length of 200 mm and weighed (W1). The specimen is immersed in hydrochloric acid for complete removal of scale. The specimen is weighed again (W2). The amount of residual scale is calculated from the formula (1) above. The result is shown in Table 6 under the heading of "Scale—Remaining amount". Samples are regarded as good in mechanical descaling performance if the amount of residual scale is no more than 0.05 mass %.

Table 6 suggests the following reasoning. The working samples Nos. 201, 202, 205, 207, 209, 210, 213, 216, 218, 219, 222, and 224 to 227 according to Example 2 of the present invention were prepared from the steels A2-J2, with their scale conditioned under the conditions a2-c2. They were found to have the thickness of $Fe_2SiO_4$ ranging from 0.01 to 1.0 μm and the ratio of the length of $Fe_2SiO_4$ to the length (10 μm) of steel furnace which is 60% and larger, both measured by using an electron microscope under prescribed conditions. These values meet requirements set up in the present invention. Containing such specific $Fe_2SiO_4$, the scale on the steel wire has a residual stress no larger than 200 MPa regardless of the cooling rate at which the wound steel wire is cooled. This contributes to the low ratio of scale scaling from the hot-rolled steel wire and the small amount of scale remaining after mechanical descaling. For the steel wire to be acceptable, the amount of residual scale should be no more than 0.05%. By contrast, the comparative samples Nos. 208, 211, 217, and 223 in Example 2 were prepared from the steels C2, D2, F2, and H2, with their scale conditioned under the conditions d2. They were found to have the thickness of $Fe_2SiO_4$ which is larger than specified in the present invention because of the excessively high dew point at the time of reoxidation. Therefore, they failed to pass due to poor mechanical descaling performance despite their low scale scaling ratio after hot rolling.

The comparative samples Nos. 203, 212, 221, and 229 were prepared from the steels A2, D2, G2, and J2, with their scale conditioned under the condition of f2. Their manufacturing process involves billet heating at a high temperature, which results in molten $Fe_2SiO_4$ that permits vigorous Fe diffusion and rapid scale growth. The resulting scale is hard to remove by descaling that follows heating, and it is forced into the steel wire during rolling, with the interface becoming rough. In the case of steels (G2: 221 and J2: 229) with a high Si content, steam oxidation that follows winding gives rise to a very thick layer of $Fe_2SiO_4$ combined with $Fe_2SiO_4$ that has occurred during heating in the heating furnace and remained unremoved. Therefore, the comparative samples failed to pass because they have a thicker layer of $Fe_2SiO_4$ than specified by the present invention and hence they are poor in mechanical descaling performance even though the hot-rolled steel wire has a low scale scaling ratio.

On the other hand, the comparative samples prepared from the steels (A2: 203, D2: 212) with a low Si content are poor in mechanical descaling performance because of the rough interface which prevents uniform and sufficient growth of $Fe_2SiO_4$. The resulting scale has a large residual stress and easily scales off from the hot-rolled steel wire. Moreover, they are poor in MD performance on account of fresh thin magnetite that occurs on the surface from which scale has scaled off at the time of cooling.

Comparative samples Nos. 206, 214, 220, and 228 were prepared from the steels B2, E2, and J2, with their scale conditioned under the condition of e2. Since their manufacturing process involves reoxidation with an excessively low dew point, they do not have sufficient $Fe_2SiO_4$ and they have their scale scaled off by compressive stress that occurs during cooling. Consequently, they failed to pass on account of the high scale scaling ratio and poor mechanical descaling performance. The poor MD performance is due to the fresh thin magnetite scale that occurs on the surface from which scale has scaled off at the time of cooling.

Comparative samples Nos. 204 and 215 were prepared from the steels A2 and E2, with their scale conditioned under the condition of g2. Since their manufacturing process involves winding at a high temperature, they have excessively grown scale, which scales off during cooling, and hence they have magnetite scale which hardly scales off. Thus, they are poor in MD performance.

Example 2 mentioned above demonstrates that the steel wire produced by hot rolling will or will not have characteristic properties suitable for mechanical descaling depending on whether or not it has its scale (which inevitably occurs in the manufacturing process) conditioned under specific conditions according to the present invention.

Example 3

The following is a description of Example 3 according to the present invention. Steel billets having the composition shown in Table 7 were heated in a heating furnace and then drawn by hot rolling into steel wires having a prescribed diameter. The resulting steel wire was wound into a coil at 755-1050° C., and the resulting wire coil was laid on the floor. Immediately after that, the wire coil was passed through wet air so that the steel wire was covered with scale resulting from oxidation induced by exposure to wet air. The wire coil was transferred by a conveyor (such as Stelmor conveyor) and then cooled under adequate conditions so that the steel wire acquires desirable mechanical properties. The thus processed steel wire is in the form of coil.

The steel wire treated as mentioned above was examined as follows for scale composition in terms of the ratio of $Fe_2O_3$, $Fe_2O_4$, FeO, and $Fe_2SiO_4$. Three specimens (500 mm long each) are taken from the steel wire in coiled form at its both ends and center, and each of them is examined by X-ray diffractometry at arbitrary three points to see the peak strengths due to individual constituents. The average of measurements is regarded as the composition of scale on each steel wire.

In addition, each steel wire was also examined as follows for the amount of scale adhering thereto and the mechanical descaling performance. First, a specimen (250 mm long) is taken from the steel wire at its both ends and center. The specimen is weighed. The measured weight is converted into a weight (W3) of a specimen which is 200 mm long (corresponding to the distance between chucks mentioned later). Then, the specimen is held between chucks 200 mm apart and stretched by the crossheads which apply a tensile strain of 4%. After dismounting from the chucks, the specimen has its scale scaled off by air blow. The specimen is cut to a length of 200 mm and weighed (W1). The specimen is immersed in hydrochloric acid for complete removal of scale. The specimen is weighed again (W2). The amount of residual scale is calculated from the formula (1) above. The amount of scale adhering to the steel wire is also calculated from the formula (2) above. The amount of residual scale is expressed in terms of the average of measurements of the amount of residual scale at both ends and center of the wound steel wire. Also, the amount of adhering scale is expressed in terms of the average of measurements of the amount of adhering scale at both ends and center of the wound steel wire.

The results of the foregoing measurements are shown in Table 8. As the amount of residual scale increases, the steel wire becomes poor in MD performance. The steel wire is regarded as acceptable if the amount of residual scale is no more than 0.05 mass %.

It is noted from Table 8 that the working samples of steel wire have adhering scale in an amount of 0.1-0.7 mass % which is larger than that of the comparative samples. This difference is due to accelerated oxidation by steam. In addition, the former have scale composed of FeO (more than 30 vol %) and $Fe_2SiO_4$ (0.1-10 vol %) and also have residual scale in an amount less than 0.05 mass %, which led to the good MD performance.

TABLE 7

| Steel | C | Si | Mn | P | S | Cr | Ni | Cu | N | Al | B | Others |
|---|---|---|---|---|---|---|---|---|---|---|---|---|
| A3 | 0.62 | 0.12 | 0.75 | 0.005 | 0.007 | 0.25 | 0.01 | — | 0.005 | 0.003 | — | Mg: 0.008 |
| B3 | 0.73 | 0.29 | 0.44 | 0.007 | 0.009 | 0.01 | 0.22 | — | 0.004 | 0.03 | 0.0015 | V: 0.03, Zr: 0.02 |
| C3 | 0.96 | 0.35 | 0.67 | 0.003 | 0.005 | 0.19 | 0.23 | — | 0.005 | 0.002 | 0.002 | |
| D3 | 1.15 | 0.4 | 0.82 | 0.004 | 0.005 | 0.13 | 0.01 | — | 0.006 | 0.04 | — | Ti: 0.02, Nb: 0.02 |

TABLE 7-continued

| Steel | C | Si | Mn | P | S | Cr | Ni | Cu | N | Al | B | Others |
|---|---|---|---|---|---|---|---|---|---|---|---|---|
| E3 | 0.08 | 0.02 | 0.35 | 0.008 | 0.004 | 0.03 | 0.01 | 0.01 | 0.002 | 0.029 | — | |
| F3 | 0.12 | 0.01 | 0.33 | 0.009 | 0.005 | 0.02 | 0.02 | 0.01 | 0.003 | 0.024 | — | |
| G3 | 0.25 | 0.02 | 0.77 | 0.011 | 0.006 | 0.04 | 0.01 | 0.01 | 0.005 | 0.046 | — | |
| H3 | 0.49 | 0.15 | 1.32 | 0.008 | 0.004 | — | — | 0.21 | 0.003 | 0.003 | — | |

TABLE 8

| Test No. | Steel | Winding Temp. (° C.) | Steam conc. (vol %) | Duration of oxidation (sec) | Amount of adhering scale (wt %) | Scale composition (vol %) FeO | Scale composition (vol %) $Fe_2SIO_4$ | Amount of scale remaining after MD (wt %) | N.B. |
|---|---|---|---|---|---|---|---|---|---|
| 301 | A3 | 845 | 0 | 0 | 0.15 | 28.0 | 0.00 | 0.072 | c.s. |
| 302 | | 830 | 10 | 7 | 0.55 | 32.1 | 7.69 | 0.028 | w.s. |
| 303 | | 848 | 30 | 20 | 0.45 | 21.0 | 12.50 | 0.230 | c.s. |
| 304 | | 820 | 30 | 1 | 0.18 | 34.1 | 0.06 | 0.110 | c.s. |
| 305 | | 835 | 5 | 7 | 0.17 | 37.0 | 0.02 | 0.080 | c.s. |
| 306 | | 770 | 25 | 7 | 0.49 | 51.0 | 1.20 | 0.035 | w.s. |
| 307 | | 849 | 50 | 3 | 0.76 | 54.8 | 12.00 | 0.003 | c.s. |
| 308 | | 755 | 38 | 8 | 0.35 | 72.9 | 8.30 | 0.034 | w.s. |
| 309 | | 800 | 40 | 9 | 0.34 | 50.2 | 2.90 | 0.047 | w.s. |
| 310 | | 900 | 15 | 8 | 0.89 | 98.0 | 0.02 | 0.004 | c.s. |
| 311 | B3 | 845 | 10 | 10 | 0.52 | 46.9 | 2.90 | 0.012 | w.s. |
| 312 | | 840 | 0 | 0 | 0.15 | 28.0 | 0.01 | 0.180 | c.s. |
| 313 | | 837 | 35 | 7 | 0.53 | 58.4 | 5.30 | 0.021 | w.s. |
| 314 | | 801 | 40 | 20 | 0.23 | 15.0 | 13.10 | 0.320 | c.s. |
| 315 | | 910 | 25 | 6 | 0.49 | 60.0 | 3.20 | 0.018 | w.s. |
| 316 | | 790 | 20 | 8 | 0.46 | 56.3 | 3.60 | 0.043 | w.s. |
| 317 | C3 | 895 | 10 | 8 | 0.96 | 74.9 | 0.03 | 0.001 | c.s. |
| 318 | | 847 | 50 | 8 | 0.78 | 96.0 | 4.90 | 0.002 | c.s. |
| 319 | | 803 | 25 | 7 | 0.45 | 58.4 | 3.80 | 0.036 | w.s. |
| 320 | | 935 | 31 | 6 | 0.65 | 57.0 | 4.20 | 0.029 | w.s. |
| 321 | | 800 | 0 | 0 | 0.12 | 28.0 | 0.00 | 0.210 | c.s. |
| 322 | D3 | 836 | 30 | 6 | 0.57 | 54.8 | 4.50 | 0.030 | w.s. |
| 323 | | 848 | 60 | 6 | 0.91 | 59.1 | 17.60 | 0.001 | c.s. |
| 324 | | 800 | 30 | 10 | 0.44 | 72.6 | 7.80 | 0.023 | w.s. |
| 325 | | 875 | 15 | 7 | 1.03 | 99.0 | 0.01 | 0.001 | c.s. |
| 326 | | 836 | 30 | 20 | 0.33 | 12.9 | 11.2 | 0.35 | c.s. |
| 327 | E3 | 780 | 32 | 8 | 0.13 | 35 | 0.02 | 0.011 | w.s. |
| 328 | | 825 | 0 | 0 | 0.07 | 13 | 0 | 0.067 | c.s. |
| 329 | | 845 | 20 | 6 | 0.39 | 42 | 0.09 | 0.015 | w.s. |
| 330 | | 1000 | 12 | 6 | 0.67 | 58 | 0.12 | 0.003 | w.s. |
| 331 | F3 | 765 | 22 | 7 | 0.19 | 38 | 0.05 | 0.019 | w.s. |
| 332 | | 810 | 55 | 8 | 0.78 | 65 | 2.8 | 0.066 | c.s. |
| 333 | | 980 | 19 | 6 | 0.63 | 59 | 0.21 | 0.021 | w.s. |
| 334 | G3 | 850 | 21 | 8 | 0.45 | 43 | 0.33 | 0.035 | w.s. |
| 335 | | 1050 | 10 | 5 | 0.91 | 87 | 5.7 | 0.082 | c.s. |
| 336 | H3 | 775 | 25 | 7 | 0.45 | 37 | 0.89 | 0.024 | w.s. |
| 337 | | 870 | 3 | 9 | 0.09 | 28 | 0.01 | 0.075 | c.s. |
| 338 | | 910 | 18 | 20 | 0.56 | 30 | 8.6 | 0.046 | w.s. |

N.B. w.s.: working sample, c.s.: comparative sample

Example 4

The following is a description of Example 4 according to the present invention. Steel billets having the composition shown in Table 9 were heated in a heating furnace and then drawn by hot rolling into steel wires having a diameter of 5.5 mm. The hot-rolled steel wire was wound while it was still hot at about 750-1030° C. The steel wire in the coiled form was passed through an atmosphere containing steam for oxidation. The scale on the steel wire varies in properties (such as cracking and scaling) depending on the cooling rate after hot rolling or the length of time for the steel wire to pass through the steam atmosphere.

The steel wire which had undergone steam oxidation was cut at arbitrary three points, from which specimens for observation of cross section (perpendicular to the lengthwise direction of the steel wire) were taken. After polishing, the cross sections were observed under an optical microscope and 16 photographs were taken with a magnification of 500. These photographs were examined to count the number of cracks (A) in the scale per 200 μm of the length of the interface. Cracks (A) are defined as those cracks which exist in the scale seen in the cross section and which have a length equivalent to more than 25% of the scale thickness. The results of counting were averaged.

The steel wire which had undergone steam oxidation was examined for scale adhesion in the following way. The steel wire in the form of coil is cut at its both ends and center, from which three specimens (500 mm long) are taken. Each specimen is examined for the area from which scale has scaled off. The ratio of the area (with scale scaled off) to the entire surface of each specimen is calculated. The thus calculated ratio is a measure that indicates the extent of scale scaling from the steel wire which has undergone hot rolling (and steam oxidation). The steel wire is rated as follows according to the ratio.

60% and more: very poor (x)

More than 40% and up to 60%: poor (Δ)

More than 20% and up to 40%: good (○)

20% and less: very good (◎)

Those steel wires which are rated as "very good" and "good" have firmly adhering scale after hot rolling (or steam oxidation), so that they do not need coating with a rust inhibitor.

The steel wire which had undergone steam oxidation was examined for mechanical descaling performance in the following way. First, a specimen (250 mm long) is taken from the steel wire at its both ends and center. The specimen is fixed to the crossheads, with the distance between chucks being 200 mm. The specimen was given a tensile strain of 4% and then removed from the chucks. The specimen has its scale scaled off by air blow. The specimen is cut to a length of 200 mm and weighed (W1). Then, the specimen is immersed in hydrochloric acid for complete removal of scale. The specimen is weighed again (W2). The measured weight is substituted into the formula (1) above to calculate the amount of residual scale. The resulting values are averaged to give the amount of scale remaining after application of strain. Residual scale deteriorates the mechanical descaling performance more as its amount increases. The steel wire is regarded as good in the mechanical descaling performance if the amount of residual scale (after application of strain) is less than 0.05 mass %.

The results of the foregoing measurement are shown in Table 10. It is known from Table 10 that the comparative samples Nos. 409, 416, and 427 are poor in mechanical descaling performance because the number of cracks (A) in scale per 200 μm of the length of interface is less than 5, the area in which scale has scaled off after hot rolling (or steam oxidation) is relatively small, and the amount of residual scale is larger than 0.05 mass % although scale adhesion is rated as very good (◎).

Comparative samples Nos. 402, 404, 407, 410, 412, 414, 418, 420, 422, 426, 429, and 431 are poor in mechanical descaling performance because the number of cracks (A) in scale per 200 μm of the length of interface is more than 20, the area in which scale has scaled off after hot rolling (or steam oxidation) is relatively large, and the adhesion of scale is poor or very poor.

By contrast, working samples Nos. 401, 403, 405, 406, 408, 411, 413, 415, 417, 419, 421, 423, 424, 425, 428, and 430 are good in mechanical descaling performance because the number of cracks (A) in scale per 200 μm of the length of interface is 5 to 20, the area in which scale has scaled off after hot rolling (or steam oxidation) is relatively small, the adhesion of scale is good or very good, and the amount of scale remaining after application of strain is less than 0.05 mass %.

TABLE 9

| Steel | C | Si | Mn | P | S | Cr | Ni | Cu | N | Al | B | Others |
|---|---|---|---|---|---|---|---|---|---|---|---|---|
| A4 | 0.06 | 0.03 | 0.35 | 0.008 | 0.004 | 0.03 | 0.01 | 0.01 | 0.002 | 0.029 | — | |
| B4 | 0.09 | 0.02 | 0.33 | 0.009 | 0.005 | 0.02 | 0.02 | 0.01 | 0.003 | 0.024 | — | |
| C4 | 0.31 | 0.15 | 1.32 | 0.008 | 0.004 | 0.11 | 0.03 | 0.19 | 0.003 | 0.003 | — | |
| D4 | 0.55 | 0.25 | 1.10 | 0.006 | 0.003 | 0.05 | 0.15 | 0.01 | 0.004 | 0.001 | — | |
| E4 | 0.62 | 0.12 | 0.75 | 0.005 | 0.007 | 0.25 | 0.01 | 0.01 | 0.005 | 0.003 | 0.002 | |
| F4 | 0.73 | 0.29 | 0.44 | 0.007 | 0.009 | 0.01 | 0.22 | 0.02 | 0.004 | 0.03 | 0.003 | V = 0.03 |
| G4 | 0.96 | 0.35 | 0.67 | 0.003 | 0.005 | 0.19 | 0.23 | 0.1 | 0.005 | 0.002 | 0.002 | |
| H4 | 1.15 | 0.4 | 0.82 | 0.004 | 0.005 | 0.13 | 0.01 | 0.06 | 0.003 | 0.04 | 0.004 | Ti = 0.02, Nb = 0.02 |

TABLE 10

| Test No. | Steel | Winding temp. (° C.) | Duration of steam oxidation (sec) | Number of cracks in scale per 200 μm of Interface length | Scale scaling | Amount of residual scale after MD (mass %) | N.B. |
|---|---|---|---|---|---|---|---|
| 401 | A4 | 750 | 4 | 12 | ◎ | 0.011 | w.s. |
| 402 | | 850 | 12 | 28 | Δ | 0.023 | c.s. |
| 403 | | 950 | 3 | 14 | ◎ | 0.022 | w.s. |
| 404 | | 1030 | 1 | 34 | X | 0.160 | c.s. |
| 405 | B4 | 805 | 2 | 15 | ◎ | 0.003 | w.s. |
| 406 | | 860 | 4 | 19 | ◎ | 0.009 | w.s. |
| 407 | | 985 | 10 | 31 | Δ | 0.15 | c.s. |
| 408 | C4 | 775 | 3 | 15 | ◎ | 0.005 | w.s. |
| 409 | | 755 | 6 | 1 | ◎ | 0.099 | c.s. |
| 410 | | 810 | 11 | 23 | Δ | 0.009 | c.s. |
| 411 | | 965 | 4 | 17 | ○ | 0.008 | w.s. |
| 412 | | 1030 | 1 | 39 | X | 0.140 | c.s. |
| 413 | D4 | 780 | 2 | 17 | ○ | 0.028 | w.s. |
| 414 | | 925 | 11 | 25 | Δ | 0.032 | c.s. |
| 415 | | 985 | 1 | 11 | ◎ | 0.014 | w.s. |
| 416 | E4 | 780 | 5 | 2 | ◎ | 0.2 | c.s. |
| 417 | | 800 | 4 | 13 | ◎ | 0.049 | w.s. |
| 418 | | 848 | 10 | 24 | X | 0.001 | c.s. |
| 419 | | 870 | 2 | 8 | ○ | 0.040 | w.s. |
| 420 | | 940 | 2 | 30 | X | 0.002 | c.s. |
| 421 | F4 | 805 | 4 | 6 | ◎ | 0.050 | w.s. |
| 422 | | 860 | 9 | 28 | Δ | 0.012 | c.s |
| 423 | | 910 | 3 | 14 | ○ | 0.043 | w.s. |
| 424 | G4 | 895 | 2 | 16 | ○ | 0.030 | w.s. |

TABLE 10-continued

| Test No. | Steel | Winding temp. (° C.) | Duration of steam oxidation (sec) | Number of cracks in scale per 200 μm of Interface length | Scale scaling | Amount of residual scale after MD (mass %) | N.B. |
|---|---|---|---|---|---|---|---|
| 425 | | 847 | 3 | 11 | ○ | 0.042 | w.s. |
| 426 | | 803 | 7 | 21 | Δ | 0.036 | c.s. |
| 427 | H4 | 790 | 5 | 3 | ◎ | 0.230 | c.s. |
| 428 | | 848 | 3 | 13 | ○ | 0.033 | w.s. |
| 429 | | 897 | 10 | 38 | X | 0.003 | c.s. |
| 430 | | 910 | 3 | 14 | ○ | 0.018 | w.s. |
| 431 | | 935 | 2 | 43 | X | 0.001 | c.s. |

N.B. w.s.: working sample, c.s.: comparative sample

Example 5

The following is a description of Example 5 according to the present invention. Steel billets having the composition shown in Table 11 were heated in a heating furnace and then drawn by hot rolling into steel wires having a diameter of 5.5 mm. After winding, the hot-rolled steel wire was passed through a steam atmosphere having a dew point higher than 30° C. for oxidation. Then, the steel wire was cooled to 600° C. at varied cooling rates so that P concentrates as desired.

The resulting steel wire was examined for the maximum value of P concentration at the P-concentrated part on the steel-scale interface, the thickness of the $Fe_2SiO_4$ layer, and the state of scale scaling.

The state of scale scaling was evaluated in the following manner.

The steel wire is cut at its both ends and center, from which three specimens (500 mm long) are taken. Each specimen is examined for the area from which scale has scaled off. The ratio of the area (with scale scaled off) to the entire surface of each specimen is calculated. The thus calculated ratio is a measure that indicates the extent of scale scaling from the steel wire which has undergone hot rolling. The steel wire is rated as follows according to the ratio.

More than 40%: poor (x)

More than 20% and up to 40%: good (Δ)

20% and less: very good (○)

Those steel wires which are rated as "very good" and "good" have firmly adhering scale after hot rolling, so that they do not need coating with a rust inhibitor. Moreover, they are less subject to being covered with the tertiary scale in the cooling step that follows winding.

The thickness of the $Fe_2SiO_4$ layer is measured in the following way. Samples are taken at three arbitrary points from the cross section of the steel wire (which is perpendicular to the lengthwise direction of the steel wire). The structure of each sample is photographed at a magnification of 5000 or above. The thickness of the $Fe_2SiO_4$ layer at three arbitrary points on one cross section is measured and the measured values are averaged. Finally, measurements at three points (both ends and center) are averaged. The measurement is accomplished by using a transmission electron microscope of field emission type (Model JEM-2010F from JEOL) at an accelerating voltage of 200 kV.

The maximum value of P concentration at the P-concentrated part is measured in the following way. Samples are taken at three arbitrary points from the cross section of the steel wire (which is perpendicular to the lengthwise direction of the steel wire). Each sample of the cross section is scanned with a beam (1 nm in diameter) from TEM-EDX at intervals of 10 nm in the direction perpendicular to the steel-scale interface, for measurement of P concentration. The maximum value of P concentration is obtained from such measurements. The process is repeated at 20 points per 500 nm of the length of the interface, and the resulting 20 measurements are averaged. This procedure is carried out for three samples taken from the steel wire at its both ends and center, and the resulting three averaged values are finally averaged to give the maximum value of P concentration. The foregoing measurement is accomplished by using a transmission electron microscope of field emission type (Model JEM-2010F from JEOL) and an EDX detector (from NORAN-VANTAGE), at an accelerating voltage of 200 kV.

The steel wire prepared as mentioned above was examined for mechanical descaling performance in the following way. First, a specimen (250 mm long) is taken from the steel wire at its both ends and center. The specimen is fixed to the crossheads, with the distance between chucks being 200 mm. The specimen was given a tensile strain of 4% and then removed from the chucks. The specimen has its scale scaled off by air blow. The specimen is cut to a length of 200 mm and weighed (W1). Then, the specimen is immersed in hydrochloric acid for complete removal of scale. The specimen is weighed again (W2). The measured weight is substituted into the formula (1) above to calculate the amount of residual scale. The resulting values are averaged to give the amount of scale remaining after application of strain. Residual scale deteriorates the mechanical descaling performance more as its amount increases. The steel wire is regarded as good in the mechanical descaling performance if the amount of residual scale (after application of strain) is no more than 0.05 mass %.

The results of the foregoing measurements are shown in Table 12. It is noted from Tables 11 and 12 that working samples Nos. 501, 503, 505, 506, 508, 509, 511, 513, 516, 517, 519, 520, 521, 524, 525, 528-531, 533-535, 537, 539, and 540, which have the composition (C: 0.005-1.2 mass %, Si: 0.1-0.5 mass %, and Mn: 0.3-1.0 mass %) as specified in the present invention, are unique in that especially for satisfying Si: 0.1-0.5 mass %, the $Fe_2SiO_4$ at the steel-scale interface is thinner than 1 μm and the P concentration at the P-concentrated part has the maximum value smaller than 2.5 mass %. Therefore, they retain scale during hot rolling and have a small ratio of area from which scale has scaled off after hot rolling. Their state of scale adhesion is regarded as good or very good. They suffer rusting very little during storage, they have less than 0.05 mass % of residual scale after application of strain, and they are good in mechanical descaling performance.

Comparative samples Nos. 502, 510, 512, 515, 523, 526, 532, 536, and 538 have the $Fe_2SiO_4$ layer formed by steam oxidation but severely suffer P concentration due to slow cooling after steam oxidation, with the maximum value of P concentration exceeding 2.5% in the P-concentrated part.

Consequently, they experienced vigorous scale scaling during hot rolling, they have a large ratio of area from which scale scaled after hot rolling, and they are poor in the state of scale adhesion. This resulted in the tertiary scale (which is a fresh thin adhering scale) occurring during cooling on the area from which scale has scaled off and also rust occurring during storage on the surface from which scale has scaled off.

Comparative samples Nos. 504, 518, 522, and 527 have no $Fe_2SiO_4$ layer but have an $SiO_2$ layer because they do not undergo steam oxidation. Consequently, they are poor in mechanical descaling performance, with the amount of residual scale exceeding 0.05 mass % after application of strain.

Comparative samples Nos. 541 to 544, which do not meet the requirement of Si: 0.01-0.5 mass % in the steel wire of the present invention, have a $Fe_2SiO_4$ layer thicker than 1 μm at the steel-scale interface regardless of whether or not they undergo steam oxidation. Consequently, they are extremely poor in mechanical descaling performance, with the amount of residual scale exceeding 0.05 mass % after application of strain.

Comparative samples Nos. 507 and 514, which underwent steam oxidation at an excessively high temperature and hence suffered rapid scale growth, are poor in MD performance, with scale scaling off during cooling and fresh thin adhering scale (tertiary scale) occurring on the surface from which scale has scaled off.

TABLE 11

| Steel | C | Si | Mn | P | S | Cr | Ni | Cu | N | Al | B | Others |
|---|---|---|---|---|---|---|---|---|---|---|---|---|
| A5 | 0.05 | 0.03 | 0.35 | 0.008 | 0.004 | 0.03 | 0.01 | 0.01 | 0.002 | 0.029 | — | |
| B5 | 0.08 | 0.02 | 0.33 | 0.009 | 0.005 | 0.02 | 0.02 | 0.01 | 0.003 | 0.024 | — | |
| C5 | 0.25 | 0.15 | 1.42 | 0.008 | 0.004 | 0.03 | 0.03 | 0.19 | 0.003 | 0.003 | — | |
| D5 | 0.43 | 0.35 | 1.25 | 0.008 | 0.002 | 0.18 | 0.02 | 0.01 | 0.002 | 0.001 | — | |
| E5 | 0.62 | 0.12 | 0.75 | 0.005 | 0.007 | 0.02 | 0.01 | 0.01 | 0.005 | 0.003 | 0.002 | Hf = 0.03 |
| F5 | 0.73 | 0.22 | 0.48 | 0.007 | 0.009 | 0.01 | 0.22 | 0.02 | 0.004 | 0.03 | 0.003 | — |
| G5 | 0.77 | 0.28 | 0.88 | 0.002 | 0.003 | — | — | — | — | — | — | — |
| H5 | 0.86 | 0.35 | 0.67 | 0.003 | 0.005 | 0.15 | 0.23 | 0.1 | 0.005 | 0.002 | 0.002 | — |
| I5 | 0.93 | 0.41 | 0.82 | 0.004 | 0.005 | 0.06 | 0.01 | 0.06 | 0.003 | 0.04 | 0.004 | Ti = 0.02, Nb = 0.02 |
| J5 | 1.14 | 0.5 | 0.94 | 0.002 | 0.003 | 0.03 | 0.02 | 0.01 | 0.001 | 0.001 | 0.002 | Mg = 0.05 |
| K5 | 0.9 | 0.7 | 0.45 | 0.009 | 0.001 | 0.02 | 0.01 | 0.03 | 0.001 | 0.001 | 0.001 | Zr = 0.02, V = 0.04 |
| L5 | 0.88 | 1.2 | 0.85 | 0.003 | 0.002 | 0.02 | 0.02 | 0.01 | 0.002 | 0.002 | 0.003 | — |

TABLE 12

| Test No. | Steel | Temp. of steam oxidation (° C.) | Duration of steam oxidation (sec) | Cooling rate after steam oxidation (° C./sec) | Thickness of $Fe_2SiO_4$ layer (μm) | Max. value of P concentration (%) | Scale scaling | Residual scale after MD (mass %) | N.B. |
|---|---|---|---|---|---|---|---|---|---|
| 501 | A5 | 753 | 5 | 12 | 0.01 | 2.3 | ○ | 0.004 | w.s. |
| 502 | | 780 | 4 | 1 | 0.012 | 3.1 | X | 0.001 | c.s. |
| 503 | | 910 | 0.6 | 21 | 0.014 | 1.6 | ○ | 0.008 | w.s. |
| 504 | | 950 | 0 | 10 | 0 | 1.9 | Δ | 0.11 | c.s |
| 505 | B5 | 855 | 4 | 13 | 0.018 | 1.8 | Δ | 0.007 | w.s. |
| 506 | | 960 | 4 | 35 | 0.019 | 1.4 | ○ | 0.009 | w.s. |
| 507 | | 1050 | 0.8 | 10 | 0.013 | 2.1 | X | 0.088 | c.s |
| 508 | C5 | 789 | 3 | 16 | 0.023 | 1.9 | ○ | 0.011 | w.s |
| 509 | | 840 | 1 | 45 | 0.05 | 1.0 | ○ | 0.009 | w.s |
| 510 | | 985 | 0.5 | 0.5 | 0.07 | 3.5 | X | 0.095 | c.s. |
| 511 | D5 | 750 | 5 | 38 | 0.13 | 1.3 | ○ | 0.021 | w.s. |
| 512 | | 795 | 3 | 0.1 | 0.28 | 3.9 | X | 0.002 | c.s. |
| 513 | | 990 | 1 | 45 | 0.31 | 0.8 | ○ | 0.015 | w.s. |
| 514 | | 1100 | 0.1 | 15 | 0.44 | 1.8 | X | 0.1 | c.s. |
| 515 | E5 | 755 | 4 | 3 | 0.02 | 2.7 | X | 0.005 | c.s. |
| 516 | | 823 | 3 | 11 | 0.04 | 2.3 | Δ | 0.042 | w.s. |
| 517 | | 848 | 2 | 15 | 0.07 | 2.2 | Δ | 0.050 | w.s. |
| 518 | | 875 | 0 | 18 | 0 | 2.2 | Δ | 0.180 | c.s. |
| 519 | | 935 | 1 | 30 | 0.1 | 1.6 | ○ | 0.038 | w.s. |
| 520 | F5 | 774 | 5 | 15 | 0.09 | 2.2 | Δ | 0.021 | w.s. |
| 521 | | 809 | 4 | 18 | 0.12 | 2.1 | Δ | 0.043 | w.s. |
| 522 | | 835 | 0 | 12 | 0 | 2.2 | Δ | 0.250 | c.s. |
| 523 | | 880 | 3.5 | 1 | 0.2 | 3.0 | X | 0.012 | c.s. |
| 524 | | 923 | 2 | 24 | 0.25 | 1.8 | ○ | 0.033 | w.s. |
| 525 | G5 | 787 | 4 | 12 | 0.08 | 2.1 | Δ | 0.045 | w.s. |
| 526 | | 820 | 3 | 2 | 0.21 | 3.1 | X | 0.042 | c.s. |
| 527 | | 855 | 0 | 30 | 0 | 1.7 | ○ | 0.220 | c.s. |
| 528 | | 890 | 2 | 22 | 0.24 | 1.6 | ○ | 0.034 | w.s. |
| 529 | | 937 | 1 | 35 | 0.35 | 0.7 | ○ | 0.023 | w.s. |
| 530 | H5 | 762 | 5 | 29 | 0.12 | 1.6 | ○ | 0.041 | w.s. |
| 531 | | 847 | 4 | 16 | 0.3 | 2.2 | Δ | 0.011 | w.s. |
| 532 | | 890 | 3 | 4 | 0.45 | 2.6 | X | 0.001 | c.s. |
| 533 | | 914 | 0.5 | 45 | 0.5 | 1.0 | ○ | 0.028 | w.s. |
| 534 | I5 | 778 | 5 | 50 | 0.33 | 0.8 | ○ | 0.044 | w.s. |
| 535 | | 843 | 4 | 48 | 0.49 | 0.9 | ○ | 0.035 | w.s. |

TABLE 12-continued

| Test No. | Steel | Temp. of steam oxidation (° C.) | Duration of steam oxidation (sec) | Cooling rate after steam oxidation (° C./sec) | Thickness of $Fe_2SiO_4$ layer (μm) | Max. value of P concentration (%) | Scale scaling | Residual scale after MD (mass %) | N.B. |
|---|---|---|---|---|---|---|---|---|---|
| 536 | | 912 | 2 | 3 | 0.57 | 2.7 | X | 0.002 | c.s. |
| 537 | | 945 | 1 | 13 | 0.46 | 2.3 | Δ | 0.045 | w.s. |
| 538 | J5 | 782 | 3 | 2 | 0.41 | 2.8 | X | 0.003 | c.s. |
| 539 | | 859 | 2 | 22 | 0.68 | 1.9 | ○ | 0.032 | w.s. |
| 540 | | 892 | 0.5 | 48 | 0.7 | 0.9 | ○ | 0.048 | w.s. |
| 541 | K5 | 870 | 0 | 15 | 1.2 | 2.2 | Δ | 0.9 | c.s. |
| 542 | | 916 | 1 | 2 | 3.5 | 3.1 | X | 1.5 | c.s. |
| 543 | L5 | 825 | 0 | 20 | 2.4 | 1.8 | Δ | 1.1 | c.s. |
| 544 | | 900 | 1 | 3 | 4.7 | 2.8 | X | 1.7 | c.s. |

N.B. w.c.: working sample, c.s.: comparative sample

The foregoing examples are not intended to restrict the scope of the present invention. They may be properly modified within the sprit and scope of the present invention.

INDUSTRIAL APPLICABILITY

The steel wire pertaining to the present invention permits scale to firmly adhere thereto and prevents scale from scaling off easily during transportation. Therefore, it is free from rusting even after storage for a long period of time. In addition, it permits scale to be descaled easily at the time of mechanical descaling or it is good in the mechanical descaling performance. By virtue of these properties, it is suitable for use as a stock of thin steel wires.

The invention claimed is:

1. A method for production of a steel product, said method comprising:

(i) heating and hot rolling a steel billet into a steel wire:

(ii) descaling the steel wire with high pressure water at 3 MPa or higher at least once before finish rolling;

(iii) winding up the hot rolled steel wire at 750 to 1000° C.;

(iv) introducing the steel wire immediately after winding in a wet atmosphere comprising steam and/or water mist having a particle diameter of 100 μm or less, thereby oxidizing the surface of steel wire;

(v) passing the steel wire through the wet atmosphere for 0.1 to 60 seconds;

(vi) performing the oxidization at a dew point of from 30 to 80° C., (vii) setting the completing temperature of the oxidation at 600° C. or higher, wherein said oxidation forms scale which has a $Fe_2SiO_4$ (fayalite) layer in contact with said steel billet wherein the $Fe_2SiO_4$ (fayalite) layer has a thickness in a range of from 0.01 to 1 μm.

2. The method according to claim 1, said steel billet comprising C: 0.05-1.2 mass % and Si: 0.01-0.50 mass %.

3. The method according to claim 2, wherein said steel billet further comprises Mn: 0.1-1.5 mass %, P: no more than 0.02 mass %, S: no more than 0.02 mass %, and N: no more than 0.005 mass %.

4. The method according to claim 2, wherein hot rolling is performed on the heated steel billet which is at 1200° C. or below when discharged from a heating furnace.

5. The method according to claim 1, wherein said oxidation forms scale which has a $Fe_2SiO_4$ (fayalite) layer in contact with said steel billet.

6. The method according to claim 1, wherein oxidation of said steel billet starts at 750-1015° C.

7. The method according to claim 1, wherein hot rolling is performed on the heated steel billet which is at 1200° C. or below when discharged from a heating furnace.

8. A mechanical descaling method, comprising applying mechanical descaling to the steel wire obtained by the production method according to claim 1.

9. The method according to claim 1, wherein the completing temperature of the oxidation is in range from higher than 600° C. to 975° C.

* * * * *